US006095124A

United States Patent [19]

Matsubara et al.

[11] Patent Number: 6,095,124

[45] Date of Patent: Aug. 1, 2000

[54] SPARK PLUG AND AN INTERNAL COMBUSTION ENGINE IGNITING SYSTEM USING THE SAME

[75] Inventors: Yoshihiro Matsubara, Yokkaichi; Kazumasa Yoshida, Nagoya; Akio Kokubo, Nagoya; Akira Suzuki, Nagoya; Makoto Yamaguchi, Owariasahi, all of Japan

[73] Assignee: NGK Spark Plug Co., Ltd., Nagoya, Japan

[21] Appl. No.: 09/144,850

[22] Filed: Sep. 1, 1998

[30] Foreign Application Priority Data

Sep. 1, 1997 [JP] Japan ..... 9-252866
Aug. 7, 1998 [JP] Japan ..... 10-224593

[51] Int. Cl.[7] ..... H01T 13/20; F02P 1/08

[52] U.S. Cl. ..... 123/594; 123/169 EL; 313/141

[58] Field of Search ..... 123/169 R, 169 EL, 123/169 MG, 594, 650, 651, 652, 143 B; 313/140, 141, 118

[56] References Cited

U.S. PATENT DOCUMENTS

| | | | |
|---|---|---|---|
| Re. 27,197 | 10/1971 | Sheilds | 123/652 |
| 2,899,585 | 8/1959 | Dollenberg | 313/143 |
| 2,934,667 | 4/1960 | Pincus | 313/131 R |
| 2,957,099 | 10/1960 | Dutterer | 313/141 |
| 4,918,569 | 4/1990 | Maeda et al. | 123/263 |
| 5,189,333 | 2/1993 | Kagawa et al. | 313/140 |
| 5,581,145 | 12/1996 | Kato et al. | 313/141 |
| 5,775,310 | 7/1998 | Ito et al. | 123/644 |
| 5,793,151 | 8/1998 | Kagawa et al. | 313/141 |
| 5,818,152 | 10/1998 | Bolduan et al. | 313/141 |

FOREIGN PATENT DOCUMENTS

| | | |
|---|---|---|
| 0 765 017A1 | 3/1997 | European Pat. Off. . |
| 0 774 813A1 | 5/1997 | European Pat. Off. . |
| 0 785 604A1 | 7/1997 | European Pat. Off. . |
| 0 812 043A1 | 12/1997 | European Pat. Off. . |
| 6-176849 | 6/1994 | Japan . |
| 9-139276 | 5/1997 | Japan . |

*Primary Examiner*—Henry C. Yuen
*Assistant Examiner*—Arnold Castro
*Attorney, Agent, or Firm*—Morgan, Lewis & Bockius LLP

[57] ABSTRACT

A spark plug having a center electrode, a ground electrode, and an insulator. The ground electrode has a firing surface formed in a tip end side, and the firing surface is opposed to a side face of the center electrode. The insulator covers the outside of the center electrode and is placed such that a tip end portion is between the side face of the center electrode and the firing surface of the ground electrode. A discharge high voltage is applied across the center electrode and the ground electrode such that a polarity of the center electrode is positive and that of the ground electrode is negative. The high voltage causes a spark discharge to be generated between the firing surface of the ground electrode and a tip end portion of the center electrode.

20 Claims, 18 Drawing Sheets

FIG. 18A

CENTER ELECTRODE IS POSITIVE

| | | RECESS DEPTH t' OF CENTER ELECTRODE (mm) PROTRUSION HEIGHT t OF CENTER ELECTRODE (mm) | | | | |
|---|---|---|---|---|---|---|
| | | t' = 1 | t' = 0.3 | 0 | t' = 0.5 | t' = 1 |
| DIAMETER OF TIP END OF CENTER ELECTRODE (mm) | 0.5 | ××× | ××× | ××× | ××× | ××× |
| | 0.6 | ××× | ××× | ○○× | ○○× | ××× |
| | 1 | ××× | ○○× | ◎◎× | ○○× | ○○× |
| | 1.2 | ××× | ○○× | ◎◎× | ◎◎× | ○○× |
| | 1.6 | ××× | ○○× | ◎◎× | ◎◎× | ○○× |
| | 1.8 | ××× | ○○× | ◎◎○ | ◎◎× | ○○× |
| | 2 | ××× | ◎◎× | ◎◎○ | ◎◎× | ◎◎× |
| | 2.2 | ××× | ◎◎× | ◎◎○ | ◎◎○ | ◎◎× |
| | 2.4 | ○○× | ◎◎○ | ◎◎○ | ◎◎○ | ◎◎○ |

(h/H) 0, 50, 70%
SPARK WITHSTAND CONDITION
0.5MPa, 60Hz, 500Hr

CHANNELING SERVE : ×
MEDIUM : ○
LIGHT : ◎

FIG. 18B

CENTER ELECTRODE IS NEGATIVE

| | | RECESS DEPTH t' OF CENTER ELECTRODE (mm) PROTRUSION HEIGHT t OF CENTER ELECTRODE (mm) | | | | |
|---|---|---|---|---|---|---|
| | | t' = 1 | t' = 0.3 | 0 | t' = 0.5 | t' = 1 |
| DIAMETER OF TIP END OF CENTER ELECTRODE (mm) | 0.5 | ××× | ××× | ××× | ××× | ××× |
| | 0.6 | ××× | ××× | ××× | ××× | ××× |
| | 1 | ××× | ××× | ○×× | ○×× | ××× |
| | 1.2 | ××× | ××× | ○○× | ○○× | ××× |
| | 1.6 | ××× | ××× | ○○○ | ○○× | ××× |
| | 1.8 | ××× | ○×× | ○○○ | ○○○ | ××× |
| | 2 | ××× | ○○× | ○○○ | ○○○ | ○○× |
| | 2.2 | ××× | ○○○ | ○○○ | ○○○ | ○○× |
| | 2.4 | ××× | ○○○ | ○○○ | ○○○ | ○○○ |

(h/H) 0, 50, 70%
SPARK WITHSTAND CONDITION
0.5MPa, 60Hz, 500Hr

CHANNELING SERVE : ×
MEDIUM : ○
LIGHT : ◎

FIG. 20A

CENTER ELECTRODE IS POSITIVE

| | | RECESS DEPTH t' OF CENTER ELECTRODE (mm) PROTRUSION HEIGHT t OF CENTER ELECTRODE (mm) | | | | |
|---|---|---|---|---|---|---|
| | | t' = 1 | t' = 0.3 | 0 | t' = 0.5 | t' = 1 |
| DIAMETER OF TIP END OF CENTER ELECTRODE (mm) | 0.6 | ◎◎◎ | ◎◎◎ | ◎◎◎ | ◎◎◎ | ○○○ |
| | 1 | ◎◎◎ | ◎◎◎ | ◎◎◎ | ◎◎◎ | ○○○ |
| | 1.2 | ◎◎◎ | ◎◎◎ | ◎◎◎ | ◎◎○ | ○○○ |
| | 1.6 | ◎◎◎ | ◎◎◎ | ◎◎◎ | ◎○○ | ○○○ |
| | 1.8 | ◎◎◎ | ◎◎○ | ◎◎○ | ○○○ | ○○△ |
| | 2 | ○○○ | ○○○ | ○○○ | ○○× | △△× |
| | 2.2 | ○○○ | ○○○ | ○○△ | △△× | ×△× |
| | 2.4 | ××× | △△× | △×× | ××× | ××× |

(h/H) 0, 50, 70%
CYCLES TO REACH 10MΩ

◎ : 20 CYCLES OR MORE
○ : 10 TO 19 CYCLES
△ : 5 TO 19 CYCLES
× : 4 CYCLES OR LESS

FIG. 20B

CENTER ELECTRODE IS NEGATIVE

| | | RECESS DEPTH t' OF CENTER ELECTRODE (mm) PROTRUSION HEIGHT t OF CENTER ELECTRODE (mm) | | | | |
|---|---|---|---|---|---|---|
| | | t' = 1 | t' = 0.3 | 0 | t' = 0.5 | t' = 1 |
| DIAMETER OF TIP END OF CENTER ELECTRODE (mm) | 0.6 | ◎◎◎ | ◎◎◎ | ◎◎◎ | ◎◎○ | ◎○○ |
| | 1 | ◎◎◎ | ◎◎◎ | ◎◎◎ | ◎○○ | ◎○○ |
| | 1.2 | ◎◎◎ | ◎◎◎ | ◎○○ | ◎○○ | ○○○ |
| | 1.6 | ◎◎◎ | ◎○◎ | ◎○◎ | ○○△ | ○○△ |
| | 1.8 | ○○○ | ○○○ | ○○○ | ○○× | ○○× |
| | 2 | ○○△ | ○○○ | ○○○ | ○○× | △△× |
| | 2.2 | ○○△ | ○○△ | ○○△ | ○○× | △×× |
| | 2.4 | ○○× | ○○× | ○○× | ○△× | ××× |

(h/H) 0, 50, 70%
CYCLES TO REACH 10MΩ

◎ : 20 CYCLES OR MORE
○ : 10 TO 19 CYCLES
△ : 5 TO 19 CYCLES
× : 4 CYCLES OR LESS

SPARK PLUG AND AN INTERNAL COMBUSTION ENGINE IGNITING SYSTEM USING THE SAME

BACKGROUND OF THE INVENTION

1. Field of the Invention

The present invention relates to a spark plug for an internal combustion engine, and also to an internal combustion engine igniting system using the same.

2. Description of the Related Art

A semicreepage discharge type spark plug for use in an internal combustion engine and having improved resistance to contamination has been known. This type of spark plug, like most spark plugs, has a center electrode, an insulator that surrounds the center electrode, and a ground electrode. The ground electrode has a firing surface formed on a tip end side and opposing a side face of the center electrode. The tip end portion of the insulator is located between the center electrode and the firing surface of the ground electrode, so that a spark discharge occurs along the surface of the tip end portion of the insulator.

When an aerial discharge type, as opposed to the above-mentioned semicreepage discharge type, spark plug is used for a long time in a low-temperature environment in which the electrode temperature is 450° C. or lower, a so-called "smolder" or "dry and wet carbon fouling" state arises. In such a state, the surface of the insulator becomes covered with an electrically conductive contamination material (e.g., carbon), which can easily result in an operation failure.

By contrast, in the above-mentioned semicreepage discharge type spark plug, a spark discharge occurs such that the discharge creeps over the surface of the insulator, and hence such a contamination material always burns off. Therefore, a spark plug of the semicreepage discharge type is superior in resistance to contamination than that of the aerial discharge type.

Referring to FIG. 6, in the semicreepage discharge type spark plug, voltage application is performed so that the center electrode 2 is negative and the ground electrode 4 is positive, and a spark frequently creeps along the surface of the insulator 3. In such a situation, a channeling phenomenon, in which the surface of the insulator 3 is cut away in a channel-like form, readily occurs. When channeling advances, problems such as impaired heat resistance of the spark plug and lowered reliability readily occur. Due to the recent advancement of engine output, a spark plug having higher durability and little or no channeling has been desired.

SUMMARY OF THE INVENTION

It is an object of the present invention to provide a spark plug that has excellent resistance to contamination, is highly durable, and in which channeling hardly occurs.

It is a further object of the present invention to provide an internal combustion engine igniting system using such a spark plug.

In order to attain the above-mentioned objects, the spark plug of the present invention has a center electrode, a ground electrode and an insulator. The ground electrode has a firing surface formed on a tip end side, and the firing surface is opposed to a side face of the center electrode. The insulator covers an outside of the center electrode, and has a tip end portion located between the side face of the center electrode and the firing surface of the ground electrode. A discharge high voltage is applied across the center electrode and the ground electrode such that the polarity of the center electrode is positive, and a spark discharge is generated between the firing surface of the ground electrode and a tip end portion of the center electrode. During an ignition process, for example, the discharge high voltage is applied such that the polarity of the center electrode is always positive.

In the spark plug having the above-mentioned configuration, the tip end portion of the insulator is located between the firing surface of the ground electrode and the side face of the center electrode. Therefore, the spark plug functions as a so-called spark plug of the semicreepage discharge type in which a spark due to a spark discharge propagates through a path which extends along the surface of the tip end portion of the insulator. The most significant feature of the spark plug is that the discharge high voltage is applied such that the polarity relationship is entirely opposite to that of a spark plug of the semicreepage discharge type of the related art (i.e., in which the center electrode is positive). Using this configuration, the inventors have succeeded in realizing an improved spark plug. That is, the spark plug of the present invention has a resistance to contamination which is as well as or higher than that of a spark plug of the semicreepage discharge type of the related art, has a remarkably reduced occurrence of channeling in the insulator, and has a very long life.

In the internal combustion engine igniting system of the present invention, the system comprises the above-identified spark plug and high-voltage applying means for applying a high voltage across the center electrode of the spark plug and the ground electrode such that the polarity of the center electrode is positive. According to this configuration, resistance to contamination of the spark plug used in the igniting system is ensured, occurrence of channeling in the insulator of the spark plug is remarkably reduced, and the spark plug has a very long life. During an ignition process, for example, the high-voltage applying means applies the discharge high voltage such that the polarity of the center electrode is always positive.

The configuration of the present invention can suppress the occurrence of channeling without lowering the spark plug's resistance to contamination for the following reason. In the configuration shown in FIG. 5A wherein the polarity of the voltage application is set to be positive on the side of the center electrode 2 will be considered. Assume that the tip end face side of the center electrode 2 in the axial direction of the center electrode is a front side and the side opposite to the front side is a rear side. Based on this assumption, among the edges of the ground electrode 4, the edge 4*f* of the rear side has fewer occurrences of sparks. The occurrence frequency of sparks at the edge 4*e* of the front side tends to be easily increased as compared with the case of the related art wherein the center electrode is negative as shown in FIG. 6. Therefore, a spark discharge easily occurs along a discharge path in which one end is the front side edge 4*e,* and which is separated from the surface of the insulator 3.

Such a spark hardly creeps over the surface of the insulator 3. The result is the creation of an environment in which a spark attack on the surface of the insulator 3 (i.e., channeling) rarely occurs. Some reasons for this effect are as follows. As shown in FIG. 5A, since the polarity of the center electrode 2 is positive, dielectric polarization causes the surface of the insulator 3 to be mainly in a negatively-charged state. Also, the occurrence of a spark at the front side edge 4*e* is more effective in reducing the dielectric strength of the discharge path than an occurrence at the rear side edge 4*f*. While propagation of a stream of negatively charged particles in a spark occurs along the surface of the insulator 3, the tendency for the propagation to detour around the surface of the negatively charged insulator 3 is enhanced by electrostatic repulsion. As a result, the probability of a spark discharge creeping over the surface of the insulator 3 is lowered, and channeling due to a spark attack rarely occurs.

In contrast, since the center electrode 2 of the related spark plug art shown in FIG. 6 is negatively charged, the surface of the insulator 3 is oppositely (i.e., positively) charged. Hence, the tendency to attract a spark toward the surface of the insulator 3 is enhanced, thereby facilitating the occurrence of channeling. In the configuration of the related art, the aerial discharge path is shorter than in the case in which a spark creeps over the surface of the insulator 3 and is then directed toward the rear side edge 4*f*. Hence, the possibility that the edge 4*f* functions as an end of the discharge path is increased, and may lead to a increase in channeling.

The above-described phenomenon is also a result of the following. Usually, a corona on the positive side easily develops from a glow corona to a brush corona or further to a streamer corona. In contrast, a corona on the negative side remains in place and hardly develops. In the case where the center electrode 2 is negative as in the related art configuration shown in FIG. 6, a corona developing from the edge 4*e* or 4*f* of the ground electrode 4 reaches the center electrode 2 and causes breakdown. In this case, the rear side edge 4*f* of the ground electrode 4 has the highest electric field, and hence the discharge path constituted by the edge can easily creeps over the insulator 3. On the other hand, the ground electrode 4 is separated from the insulator 3 via the air, and hence the concentration of the electric field is hardly affected by the insulator 3.

In the configuration of the present invention wherein the voltage application is performed so that the center electrode 2 is positive as shown in FIG. 5A, a corona developing at the edge 2*e* of the center electrode 2 reaches the ground electrode 4 and causes breakdown. The discharge path formed by this breakdown slightly floats from the insulator 3, and hence channeling due to a spark attack rarely occurs. Since a corona extends from the insulator 3 as described above, the insulator 3 is rarely punctured for the following reason.

In the related art configuration shown in FIG. 6, a corona extends from the ground electrode 4, and hence stress due to the high voltage is directly applied to the insulator 3. In contrast, in the configuration of the present invention shown in FIG. 5A, the voltage applied to the insulator 3 is low.

On the other hand, when contamination proceeds and an electrically conductive layer F such as carbon is formed on the surface of the insulator 3 as shown in FIGS. 7A and 7B, the electric resistance of the surface is lowered. As a result, a spark is easily generated between the ground electrode 4 and the insulator 3 which is close to the ground electrode 4. This spark discharge causes the conductive layer F to be burned away, resulting in improved resistance to contamination of the spark plug.

From the viewpoint above, the spark plug of the present invention may be considered to have the following configuration. The spark plug comprises a center electrode, a ground electrode and an insulator. The ground electrode has a firing surface formed in a tip end side, and the firing surface is opposed to a side face of the center electrode. The insulator covers an outside of the center electrode and is placed such that a tip end portion of the insulator is between the side face of the center electrode and the firing surface of the ground electrode. A discharge high voltage is applied across the center electrode and the ground electrode such that the polarity of the center electrode is positive and the polarity of the ground electrode is negative. The high voltage causes a spark discharge between the firing surface of the ground electrode and a tip end portion of the center electrode. When an electrically conductive material adheres to the surface of the insulator and the discharge voltage between the ground electrode and the insulator becomes lower than that between the ground electrode and the center electrode, a spark is generated between the ground electrode and the insulator. This spark burns away the adhering conductive material.

In the above-mentioned mechanism, when the degree of contamination is low, the discharge between the ground electrode and the center electrode may be performed by means of an aerial discharge only. When the degree of contamination advances, an aerial discharge may occur between the ground electrode and the conductive material adhering on the surface of the insulator, and the current may flow to the center electrode through the adhering conductive material. As a result, there may be a case in which a creepage discharge will not exist in the discharge process.

In the spark plug and the igniting system, the smaller the diameter of a section perpendicular to the axis of the tip end portion of the center electrode, the smaller the volume of the tip end portion of the center electrode and the less heat absorption of a flame produced by the ignition. As a result, ignitability of the spark plug is improved. Furthermore, since the surface areas of the tip end portion of the center electrode and that of the insulator which are to be cleaned by generation of a spark are narrowed, resistance to contamination of the spark plug is improved. Conversely, from the viewpoint of channeling suppression, a larger diameter of a section perpendicular to the axis may be advantageous because the discharge path can be more easily dispersed. In order to balance these requirements, it is preferable to adjust the section diameter (i.e., the diameter of a section perpendicular to the axis of the tip end portion of the center electrode) to be in a range of 0.6 to 2.2 mm. When the section diameter is smaller than 0.6 mm, the amount of channeling suppression may be insufficient. In contrast, when the section diameter is greater than 2.2 mm, resistance to contamination may be insufficiently ensured. The section diameter of the tip end portion of the center electrode is therefore more preferably adjusted to be in a range of 1 to 1.8 mm.

The center electrode may be configured so that a tip end face is flush with or protrudes from a tip end face of the insulator. Alternatively, the center electrode may be configured so that the tip end face is recessed into the tip end face of the insulator. In the former case, the larger the protrusion height t of the tip end face of the center electrode from that of the insulator, the more easily the propagation path of a spark which is formed around the center electrode is dispersed. This results in the spark plug having improved resistances to channeling and contamination.

In contrast, the larger the recess depth t' of the center electrode, the more easily the propagation path of a spark tends to be close to the surface of the insulator. This causes a spark to propagate so that the spark is pressed against the surface of the insulator, resulting in impaired resistance to channeling. Therefore, when the center electrode is to protrude from the insulator, the protrusion height t is preferably set to be 1 mm or less. When the center electrode is to be conversely recessed, the recess depth t' is preferably adjusted to be in a range of 0.3 mm or less. When the protrusion height t is larger than 1 mm, resistances to channeling and contamination of the spark plug may be insufficient. The protrusion height t is more preferably set to be 0.5 mm or shorter. In contrast, when the recess depth t' is larger than 0.3 mm, resistance to channeling may be insufficient. The recess depth t' is more preferably adjusted to be 0.1 mm or less.

The spark plug of the present invention may be configured as follows. A cylindrical metal shell covers the outside of the insulator. The basal end side of the ground electrode is joined to an end portion of the metal shell, and the tip end side of the ground electrode is bent back toward the center electrode. A tip end face (i.e., firing surface) of the ground electrode is opposed to the side face of the center electrode, with the tip end portion of the insulator interposed between the tip end face and the side face. Assume that the tip end face side of the center electrode in an axial direction of the center electrode is a front side and a side opposite to the front side is a rear side. Based on this assumption, the tip end face of the insulator is located in front of an edge of the rear side of an end face of the ground electrode. According to this configuration, resistance to channeling of the spark plug is further improved for the following reason.

As shown in FIG. 5A, a discharge path which is terminated at the rear side edge 4*f* of the end face of the ground electrode 4 is blocked by the insulator 3. Hence, a discharge from the front side edge 4*e* which is mainly composed of an aerial discharge easily occurs. When the tip end face of the insulator 3 is rearwardly recessed from the rear side edge 4*f* of the end face of the ground electrode 4, resistance to channeling may be lowered for the following reason. A corona developing from the edge 2*e* of the center electrode 2 reaches the rear side edge 4*f* of the end face of the ground electrode 4, and breakdown is finally caused. In the discharge path which is completed as a result of the breakdown, as shown in FIG. 5B, the frequency of occurrence of discharges which creep over the tip end face the insulator 3 in the vicinity of the rear side edge 4*f* is increased.

In this case, the distance h in the axial direction of the center electrode between the edge of the front side of the end face of the ground electrode and the tip end face of the insulator is preferably adjusted in a range of 0.7 mm or less, and more preferably in a range of 0.5 mm or less. When the distance in the axial direction of the center electrode between the edge of the rear side of the end face of the ground electrode and the edge of the front side of the end face of the ground electrode is H, and the distance between the tip end face of the insulator and the edge of the front side of the end face of the ground electrode is h, h/H is preferably set to be 0.5 or less. When h and h/H are set as described above, the frequency of occurrence of a spark in which the rear side edge of the end face of the ground electrode is an end of the discharge path (i.e., a spark which easily creeps over the surface of the insulator) is reduced and resistance to channeling is further improved. Furthermore, H−h (i.e., the protrusion amount of the tip end face of the insulator from the rear side edge of the end face of the ground electrode) is preferably set to be 1.2 mm or less. According to this configuration, even when the rear side edge of the ground electrode functions as an end of the discharge path, it is difficult for a spark to strongly attack the surface of the insulator. Hence resistance to channeling of the spark plug can be improved.

In the spark plug of the present invention, a plurality of ground electrodes may be arranged around the axis of the center electrode. According to this configuration, a spark is generated at plural positions arranged in the circumferential direction about the axis of the center electrode. Therefore, resistance to contamination of the spark plug can be further improved.

In the spark plug of the present invention, at least a portion of the firing surface of the ground electrode is made of either a metal in which at least one of Ru, Rh, Pd, Os, Ir, and Pt is a principal component, or a composite material member which is mainly composed of the metal. Generally, an electrode of a negative potential is easily consumed by collisions of positive ions which are produced by discharges, and hence, such an electrode has a higher degree of consumption than an electrode of a positive potential. According to this configuration, therefore, resistance to consumption of the ground electrode 4 of a negative potential in which the degree of consumption is large can be improved.

Preferably, at least part of a range which extends from H/2 of the firing surface of the ground electrode to the tip end is made of either a metal in which at least one of Ru, Rh, Pd, Os, Ir, and Pt is a principal component, or a composite material member which is mainly composed of the metal. According to this configuration, the spark reachable portion on the side of the ground electrode can be dispersed, and hence resistance to consumption can be further improved.

The internal combustion engine igniting system of the present invention may be configured so as to include a plurality of spark plugs of the present invention. In this case, high-voltage applying means may apply a discharge high voltage to all of the spark plugs such that the polarities of the center electrodes are positive. According to this configuration, channeling in the insulators can be remarkably reduced, while ensuring the spark plugs' resistance to contamination.

BRIEF DESCRIPTION OF THE DRAWINGS

FIGS. 18A and 18B are tables showing results of tests of checking resistance to channeling of spark plugs;

FIGS. 20A and 20B are tables showing results of the resistance to contamination test.

DETAILED DESCRIPTION OF THE INVENTION

Hereinafter, several embodiments of the present invention will be described with reference to the accompanying drawings.

Figure 1:
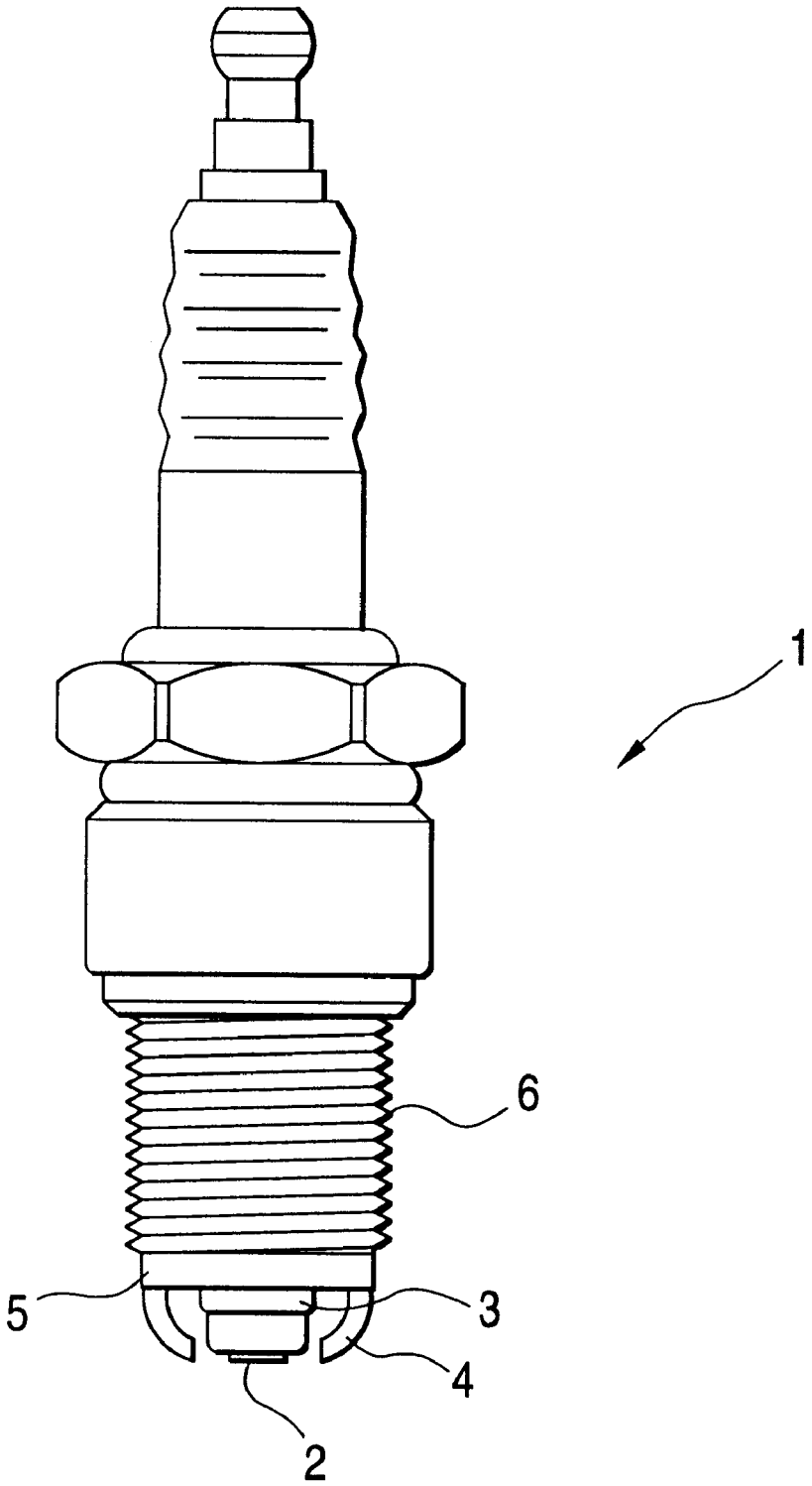
FIG. 1 is an overall front view showing an example of the spark plug of the present invention.

As illustrated in FIG. 1, the spark plug 1 of the present invention is constituted by a cylindrical metal shell 5, an insulator 3, a center electrode 2 and a ground electrode 4. The insulator 3 is fitted into the metal shell 5 so that a tip end portion protrudes from the metal shell 5. The center electrode 2 is disposed inside the insulator 3. The ground electrode 4 has the basal end side joined to the metal shell 5 and the tip end side (i.e., end face) located so as to be opposed to the side face of the center electrode 2. The outer diameter of the tip end portion of the insulator 3 is located between the end face of the ground electrode 4 and the side face of the center electrode 2. A threaded portion 6 for attaching the spark plug 1 to a cylinder head (not shown) is formed in the outer peripheral face of the metal shell 5.

Both the center electrode 2 and the ground electrode 4 are made of a Ni alloy (e.g., an Ni-base heat resistant alloy such as inconel). In order to improve heat transfer, a core member (not shown) made of Cu (or an alloy of Cu) that has excellent thermal conductivity is embedded in each of the electrodes as required. The insulator 3 is composed of, for example, a sintered member of ceramics such as alumina or aluminum nitride.

Figure 2:
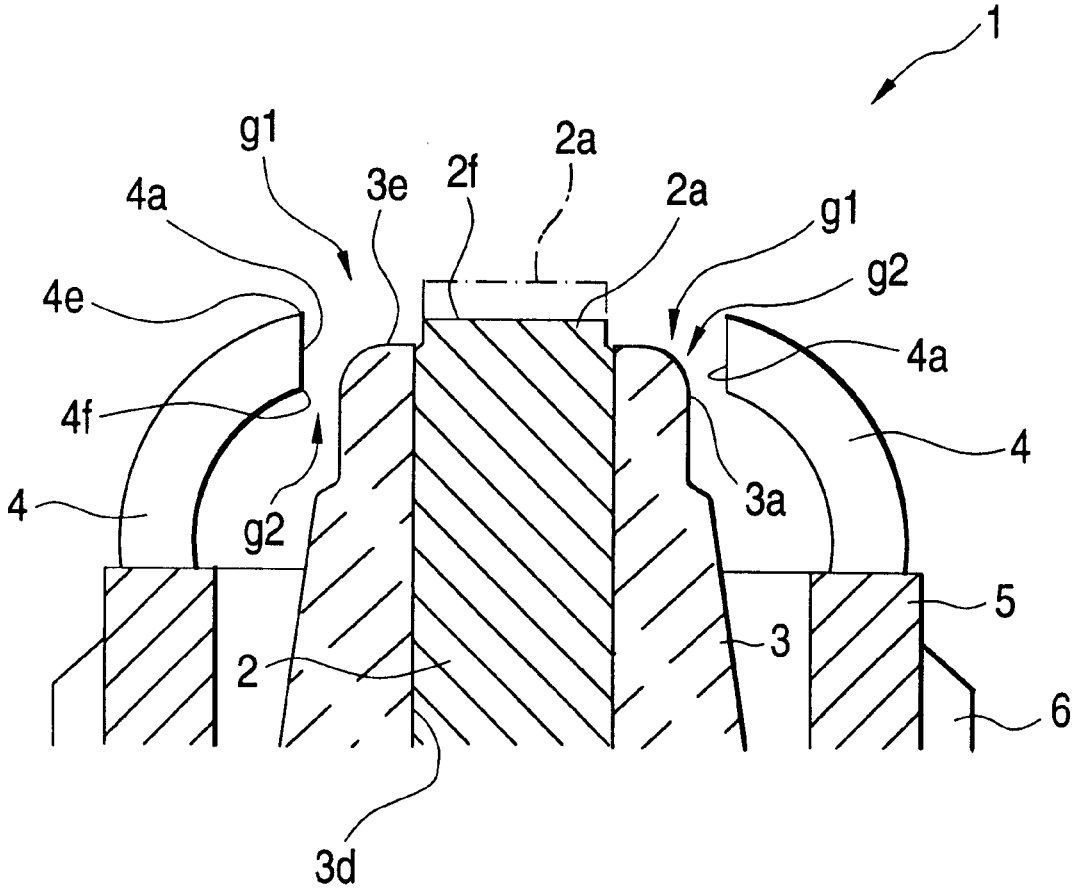
FIG. 2 is a side section view showing main portions of the spark plug.

As shown in FIG. 2, a hole portion 3*d* into which the center electrode 2 is to be fitted in the axial direction of the insulator is formed in the insulator 3. The metal shell 5 is made of a metal such as low carbon steel and formed into a cylindrical shape so as to constitute a housing of the spark plug 1. One ground electrode 4 is formed in each side of the center electrode 2, totaling two ground electrodes.

Each of the ground electrodes is bent so that its end face (hereinafter, also referred to as a firing surface) 4*a* is opposed in parallel to the side face of a tip end portion 2*a* of the center electrode 2. The other end of each ground electrode is fixed to and integrated with the metal shell housing 5, by welding or the like.

Figure 12A:
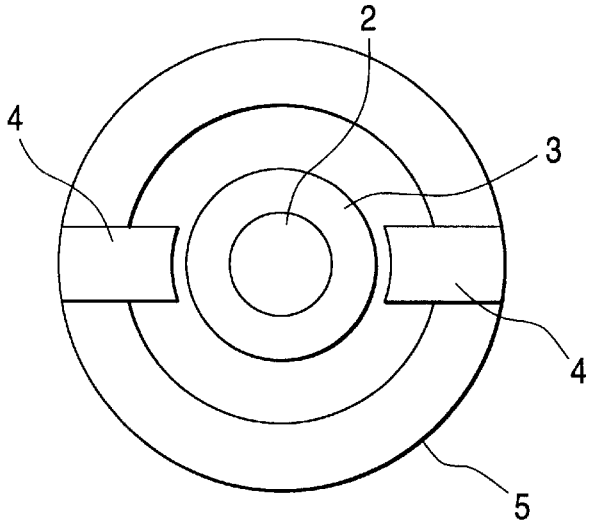
FIGS. 12A to 12C are plan views showing several embodiments of a spark plug having a plurality of ground electrodes.
Figure 12B:
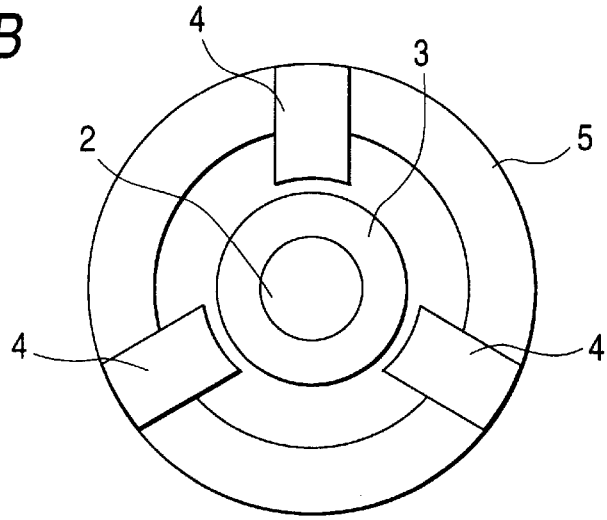
Figure 12C:
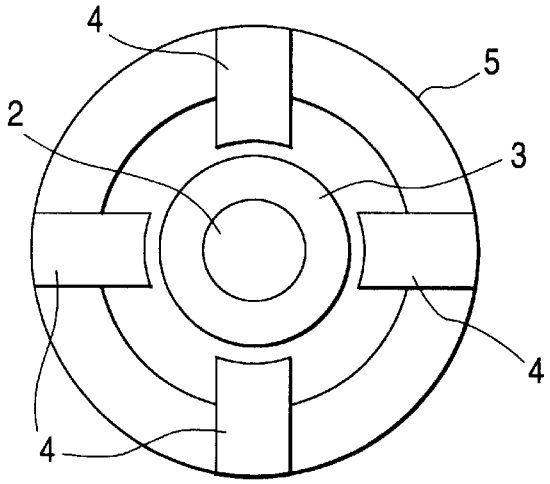

Alternatively, only one ground electrode 4, or as shown in FIGS. 12A to 12C, a plurality of ground electrodes 4 may be disposed in the spark plug 1. For example, in FIG. 12B, three ground electrodes 4, or, in FIG. 12C, four ground electrodes 4 are arranged at substantially constant angular intervals about the axis of the center electrode 2.

Figure 10:
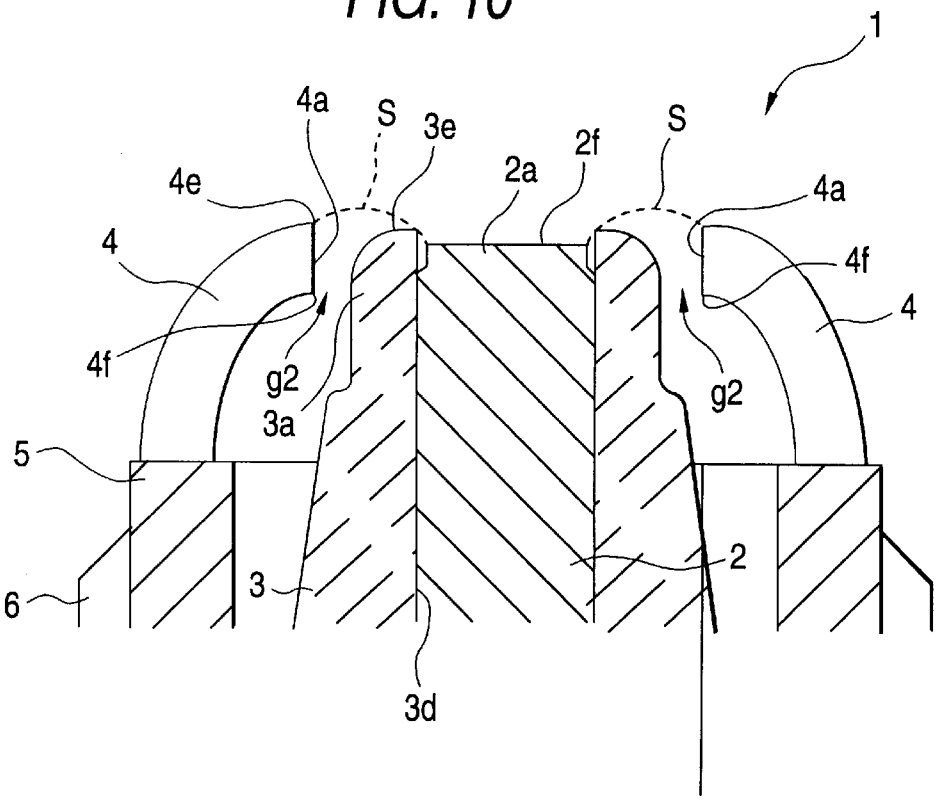
FIG. 10 is a section view showing a first modification of the spark plug of FIG. 2.

Returning to FIG. 2, the insulator 3 is placed such that a tip end portion 3*a* is located between the side face of the center electrode 2 and the firing surface 4*a* of the ground electrode 4. Assume that the tip end side of the center electrode 2 in the axial direction thereof is a front side, and that a side opposite the front side is a rear side of the center electrode 2; under this assumption, the tip end face 3*e* of the insulator 3 is located in front of an edge 4*f* of the rear side of the end face 4*a* of the ground electrode 4. The tip end face 2*f* of the center electrode 2 protrudes from the tip end face 3*e* of the insulator 3 by a predetermined height. The tip end face 2*f* of the center electrode 2 substantially coincides with a tip end edge 4*e* of the firing surface 4*a* of the ground electrode 4. Alternatively, as shown by a one-dot chain line, the tip end face 2*f* may protrude from the tip end edge 4*e*, or, as shown in FIG. 10, may be recessed therefrom.

Figure 3:
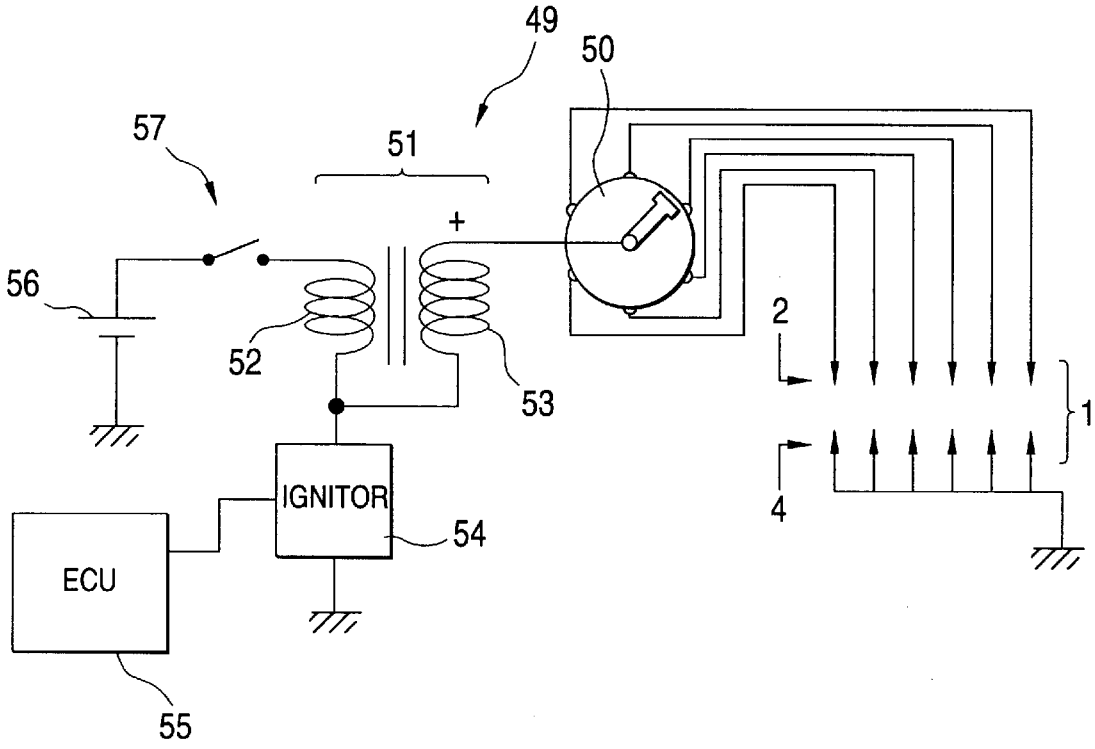
FIG. 3 is a circuit diagram showing an example of the internal combustion engine igniting system of the present invention.

Returning again to FIG. 2, a discharge high voltage for ignition is applied across the center electrode 2 of the spark plug 1 and the ground electrode 4 such that the polarity of the center electrode 2 is positive. FIG. 3 shows an example of a configuration of an ignition system (i.e., high-voltage applying unit) which performs an application of such a discharge high voltage. In the ignition system 49, each spark plug 1 is grounded at the ground electrode 4, and connected at the center electrode 2 to a distributor 50. The ignition system 49 and the spark plugs 1 constitute the internal combustion engine igniting system of the present invention.

An ignition coil 51 of the ignition system 49 consists of a primary coil 52 and a secondary coil 53. The primary coil 52 is powered by a battery 56 via an ignition switch 57, and is connected to an ignitor 54. The ignitor is of known configuration, and consists of a contactless switch portion such as a power transistor and peripheral control circuits. The secondary coil 53 is connected to the distributor 50.

When a electrical control unit (ECU) 55 including a control CPU gives an interruption command signal to the ignitor 54 at a predetermined ignition timing, the ignitor 54 operates the contactless switch portion so as to interrupt the energization of the primary coil 52. As a result, a high-voltage induction current is generated in the secondary coil 53, and this current is distributed by the distributor 50 to the spark plugs 1. The connection polarity of the battery 56 and the winding directions of the primary and secondary coils 52 and 53 are determined so that a positive induction current is generated in the secondary coil 53 and applied to the connection terminal of the distributor 50 (i.e., the center electrode 2).

Figure 4:
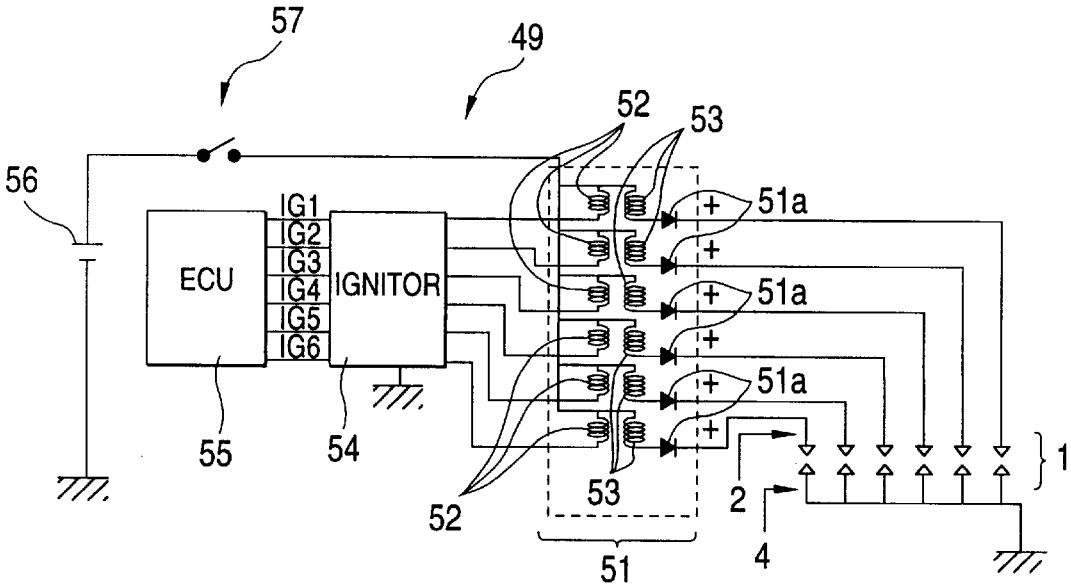
FIG. 4 is a circuit diagram showing a modification of the internal combustion engine igniting system of the present invention.

On the other hand, the ignition system 49 shown in FIG. 4 is configured so that the distributor 50 is not used, and a voltage is instead directly applied to the spark plugs 1 from individual ignition coils 51. In this system, the ignitor 54 has contactless switch portions that respectively correspond to the individual ignition coils 51. The contactless switch portions individually receive an interruption command signal from respective output ports of the control unit 55 and are interrupt-driven at a predetermined timing. In this case, the connection polarity of the battery 56 to the center electrode 2 and the winding directions of the primary and secondary coils 52 and 53 are determined so that a positive induction current is generated in each of the secondary coils 53 and applied to the connection terminal of the spark plug 1. In order to prevent the spark plugs 1 from being reenergized when the respective contactless switch portions of the ignitor 54 are returned from the cut-off state to the conduction state, diodes 51*a* are connected between the ignition coils 51 and the spark plugs 1.

Figure 16A:
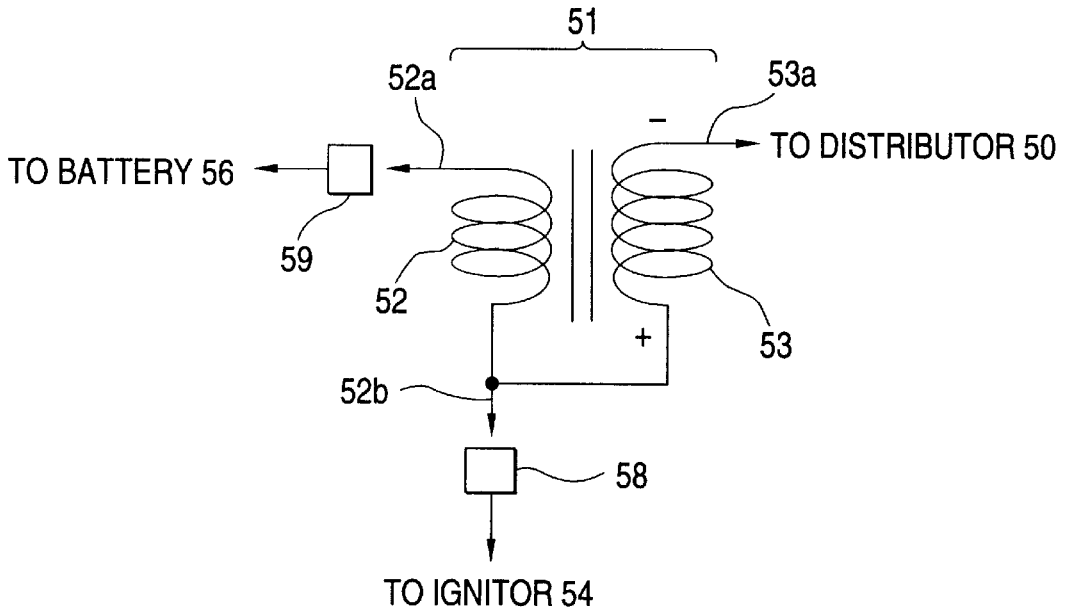
FIGS. 16A and 16B are diagrams showing a modification of an ignition system of the related art to that which is suitable for the present invention.
Figure 16B:
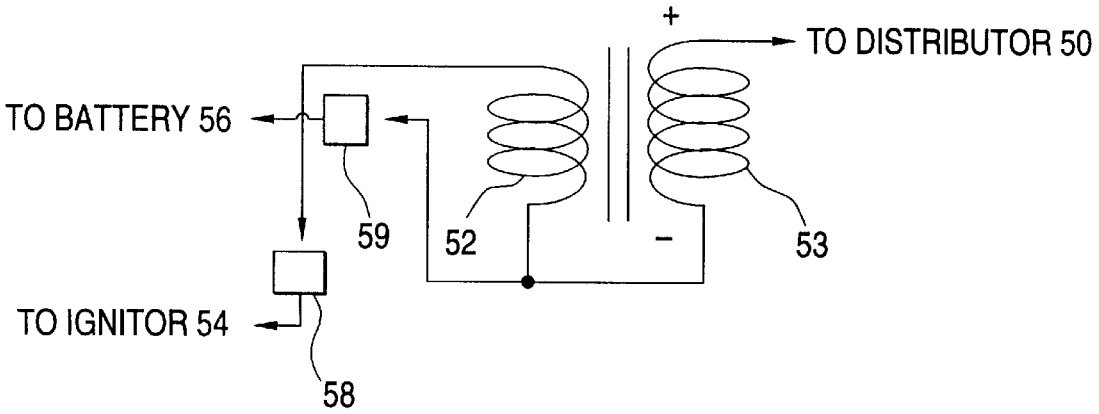

The ignition system 49 may be newly produced as a dedicated one, or may be produced by modifying an existing ignition system. For example, an existing ignition system in which the voltage application polarity is set so that the center electrode 2 of the spark plug 1 is negative, may be used by modifying the specifications of the system. As shown in the existing ignition system of FIG. 16A, for example, a negative terminal 52*a* of the primary coil 52 is connected to a socket 59 on the battery 56 side, and a positive terminal 52*b* is connected to a socket 58 on the ignitor 58 side. When the connection relationship is inverted as shown in FIG. 16B, it is possible to obtain a voltage application polarity that is suitable for the present invention.

Figure 17A:
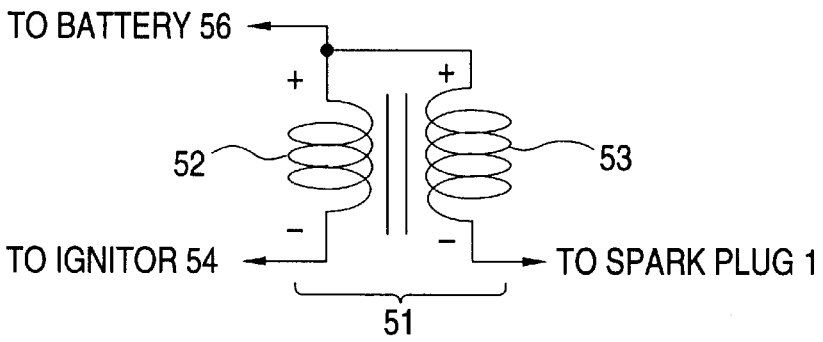
FIGS. 17A to 17C are diagrams showing various other modifications of the ignition systems of the related art.
Figure 17B:
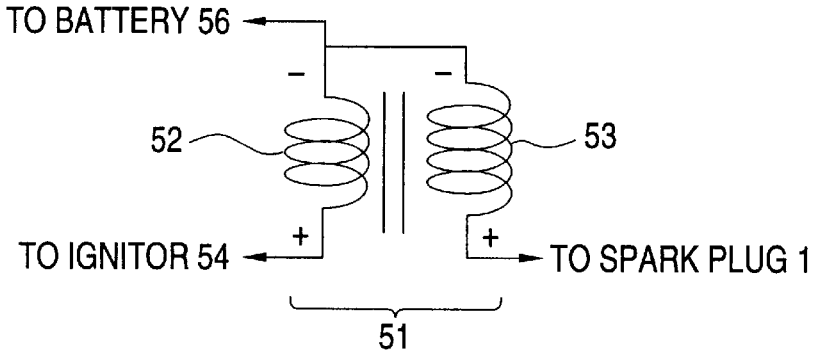
Figure 17C:
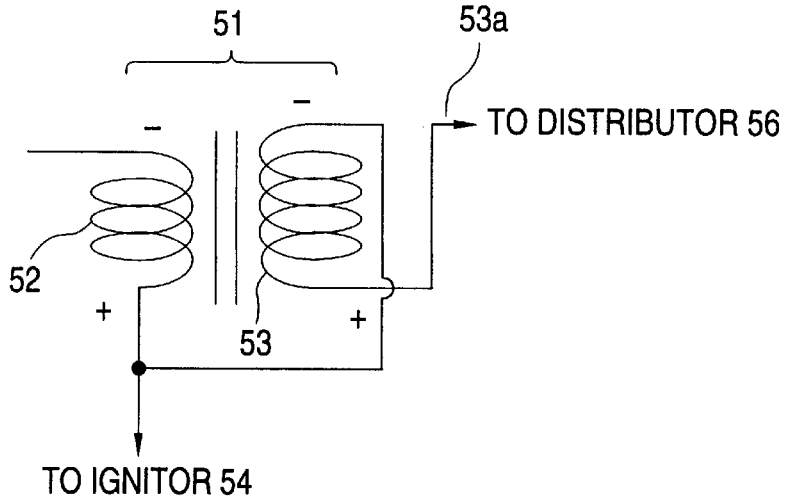

The following method may be employed to change the design of an existing ignition system. As shown in FIG. 17A, an existing ignition system having the output polarity of the secondary coil 53 that is connected to the spark plug 1 being negative will be considered. In order to modify the existing system so that it complies with the requirements of the igniting system of the present invention, the design may be changed so that, as shown in FIG. 17B, the winding direction of one of the secondary and primary coils 53 and 52 is inverted. Alternatively, the design may be changed so that, as shown in FIG. 17C, the connection relationships of the secondary coil 53, and the distributor 50 and the ignitor 54 are inverted.

Hereinafter, the operation of the spark plug 1 will be described.

Figure 5A:
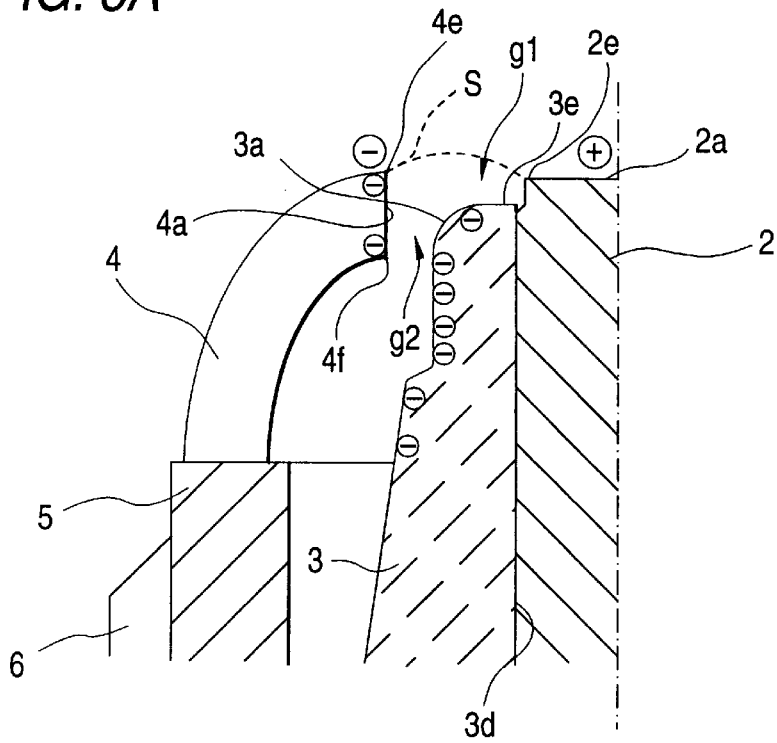
FIGS. 5A and 5B are views illustrating spark discharge behavior in the spark plug of the present invention.
Figure 5B:
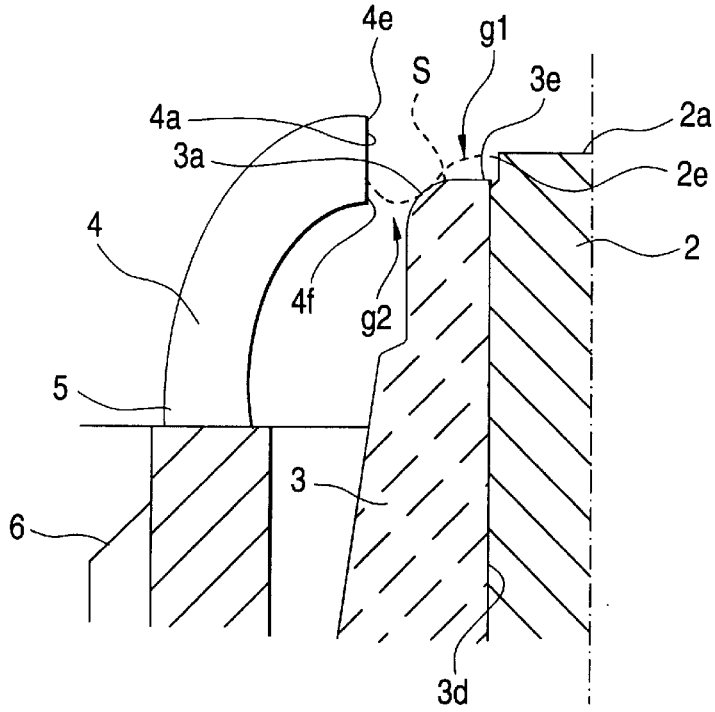

The spark plug 1 is attached at the threaded portion 6 (shown in FIG. 1) to an internal combustion engine such as a gasoline engine, and then used as an ignition source for an air-fuel mixture supplied to a combustion chamber. The discharge high voltage is applied by the ignition system 49 shown in FIG. 3 or 4 to the spark plug 1 so that the center electrode 2 is positive and the ground electrode 4 is negative. Accordingly, as shown in FIGS. 5A and 5B, a spark S is generated by discharge between the firing surface 4*a* of the ground electrode 4 and the tip end portion 2*a* of the center electrode 2, and the air-fuel mixture is ignited. The tip end portion 3*a* of the insulator 3 is located between the firing surface 4*a* and the side face of the center electrode 2. Therefore, the spark plug functions as a spark plug of the semicreepage discharge type in which the spark S propagates in a path along the surface of the tip end portion of the insulator 3. In the spark plug, however, the voltage application polarity is opposite to that of the spark plug of the known spark plug shown in FIG. 6. That is, the center electrode 2 of the spark plug of the present invention is positive rather than negative. According to this configuration, channeling in the insulators 3 can be remarkably reduced, while ensuring resistance to contamination. Hereinafter, differences in discharge behavior between the spark plug 1 of the present invention and the known spark plug shown in FIG. 6 will be described.

In the spark plug of the present invention shown in FIG. 5A, because the center electrode 2 is positively charged, dielectric polarization causes the surface of the insulator 3 to be negatively charged. With respect to a spark which is formed as a stream of negatively charged particles, propagation occurs on a path along the surface of the insulator 3. Electrostatic repulsion enhances the tendency for the propagation to detour around the surface of the negatively charged insulator 3. As a result, the probability of a spark discharge creeping over the surface of the insulator 3 is lowered and channeling due to a spark attack hardly occurs.

Figure 6:
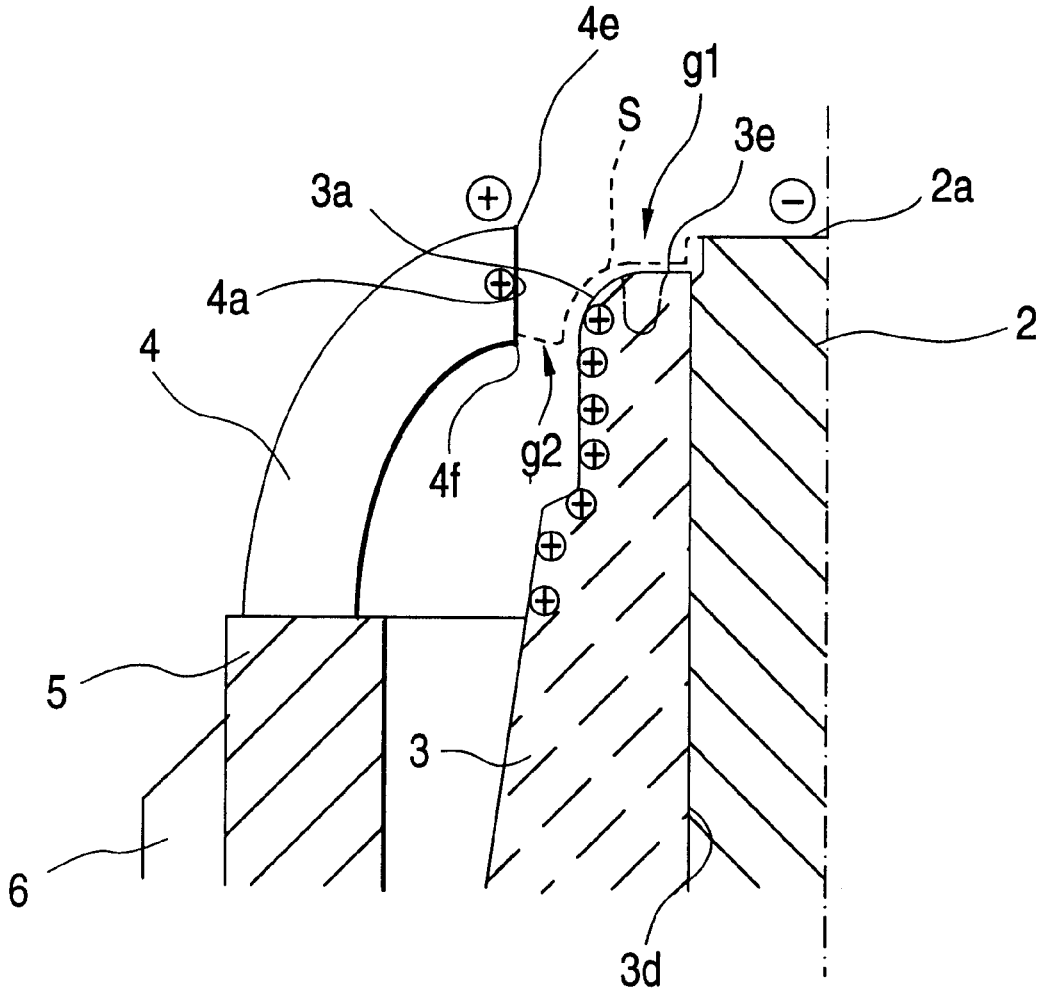
FIG. 6 PRIOR ART
FIG. 6 is a view illustrating spark discharge behavior in a spark plug of the related art.

In contrast, in the configuration of the known spark plus shown in FIG. 6, the center electrode 2 is negatively charged, and the surface of the insulator 3 is oppositely charged or positively charged. Hence the tendency for attracting a spark toward the surface of the insulator 3 is enhanced, thereby facilitating the occurrence of channeling.

In the present invention wherein the voltage application is performed such that the polarity of the center electrode 2 is positive, it is assumed that the tip end side of the center electrode 2 in the axial direction of the center electrode 2 is a front side and the side opposite the front side is a rear side. Among the edges of the ground electrode 4, sparks occur less frequently at the edge 4*f* of the rear side of the end face 4*a* and more frequently at the edge 4*e* of the front side, as compared with the case where the center electrode is negative (FIG. 6). As a result, an environment is created in which a spark bombardment to the surface of the insulator 3 (i.e., channeling) occurs less frequently. The reason for this effect is considered to be as follows.

The surface of the insulator 3 is negatively charged. Therefore, with respect to a spark discharge detouring around the surface, the aerial discharge path of a spark generated from the front side edge 4*e* is shorter than that a spark generated from the rear side edge 4*f*. By contrast, in the known spark plug of FIG. 6. wherein the surface of the insulator 3 is positively charged, the aerial discharge path is shorter when a spark creeps over the surface of the insulator 3 and is then directed toward the rear side edge 4*f*. Hence, the frequency of sparks directed toward the edge 4*f* is very high, resulting in a more channeling.

The channeling phenomenon is caused by the following additional reason. Usually, a glow corona on the positive side easily develops into a brush corona, or even further into a streamer corona. In contrast, a corona on the negative side remains in place and hardly develops. When the center electrode 2 is negative, as in the related spark plug shown in FIG. 6, a corona developing from the edge 4*e* or 4*f* of the ground electrode 4 reaches the center electrode 2 and causes breakdown. Since in this case, as shown in FIG. 6 the rear side edge 4*f* of the ground electrode 4 has the highest electric field, the discharge path constituted by this edge can easily creep over the insulator 3.

In contrast, the ground electrode 4 of the present invention is separated from the insulator 3 via air, and hence the concentration of the electric field is hardly affected by the insulator 3. When the voltage application is performed so that the center electrode 2 is positive as shown in FIG. 5A, a corona developing from the edge 2*a* of the center electrode 2 reaches the ground electrode 4 to cause a breakdown. The discharge path formed by this breakdown floats slightly away from the insulator 3 as shown in FIG. 5B, and hence channeling due to a spark attack hardly occurs.

Since a corona extends from the insulator 3 as described above, the insulator 3 is rarely punctured for the following reason. In the known spark plug shown in FIG. 6, a corona extends from the ground electrode 4, and hence high voltage stress is directly imparted to the insulator 3. By way of contrast, only a low voltage is applied to the insulator 3 of the present invention shown in FIG. 5A.

Figure 7A:
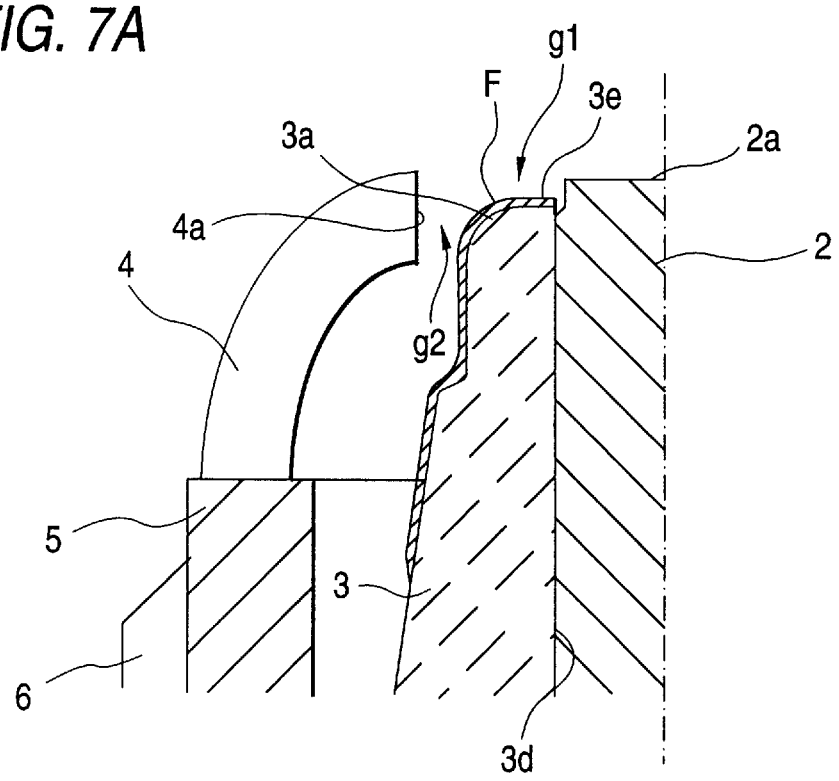
FIGS. 7A and 7B are views illustrating spark discharge behavior in the spark plug of the present invention in the case where the spark plug is contaminated.
Figure 7B:
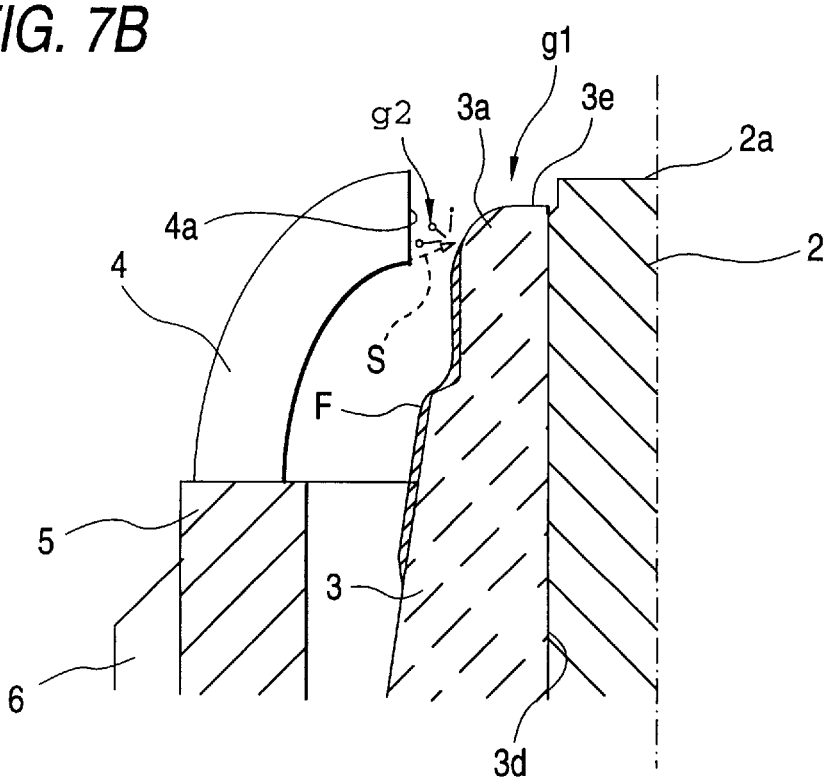

When the spark plug 1 is contaminated with so-called "smolder" or "dry and wet carbon fouling", the discharge behavior is different from that described above. When, as shown in FIGS. 7A and 7B, contamination advances and an electrically conductive layer F such as carbon is formed on the surface of the insulator 3, both the electrical resistance of the surface and the discharge voltage are lowered. As a result, a spark is easily generated between the ground electrode 4 and the insulator 3, which is located close to the ground electrode 4. This spark discharge causes the conductive layer F to be burned away, resulting in decreased contamination of the spark plug 1. After the conductive layer F is burned away, the discharged mode is returned to that of FIGS. 5A and 5B.

Figure 8A:
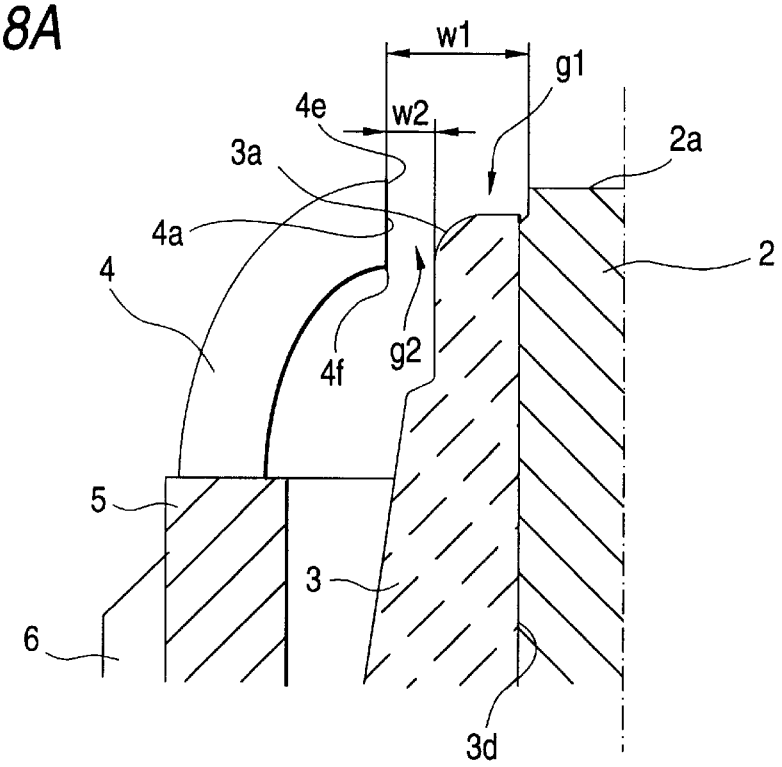
FIGS. 8A to 8C are section views showing the formation of two gaps in the spark plug of FIG. 2.

In the spark plug 1 of the present invention shown in FIGS. 5A and 5B, the tip end of the center electrode 2 protrudes beyond the insulator 3, resulting in the formation of two gaps. A first gap g1 is formed between the outer peripheral face of the protruding portion and the firing surface 4*a* of the ground electrode 4. A second gap g2 is formed between the outer peripheral face of the insulator 3 and the firing surface 4*a*. Therefore, the spark plug 1 has a contamination detection and cleaning function. When the degree of contamination is not that high, a spark discharge is generated in the first gap g1, and when the degree of contamination is high, a spark discharge is generated in the second gap g2. The progress of contamination of the surface of the insulator 3 is thereby automatically detected and the contaminant is burned away. Even when two gaps g1 and g2 are formed in this way, if the voltage is applied in a polarity relationship opposite to that described above, most of a spark discharge occurs in the second gap g2, and the first gap g1 performs substantially no function. As a result, even when the surface of the insulator 3 is not contaminated, the surface is always exposed to a spark attack by a constant discharge in the second gap g2, and hence channeling easily occurs. By contrast, in the spark plug 1 of the present invention, when the degree of contamination is high, the number of discharges to the insulator 3 is increased, so that channeling hardly advances. In order to make the effect more conspicuous, it is preferable to, as shown in FIG. 8A, adjust the width w1 of the first gap g1 to be in a range of 1.4 to 1.8 mm, and the width w2 of the second gap g2 to be in a range of 0.4 to 0.8 mm.

Figure 8B:
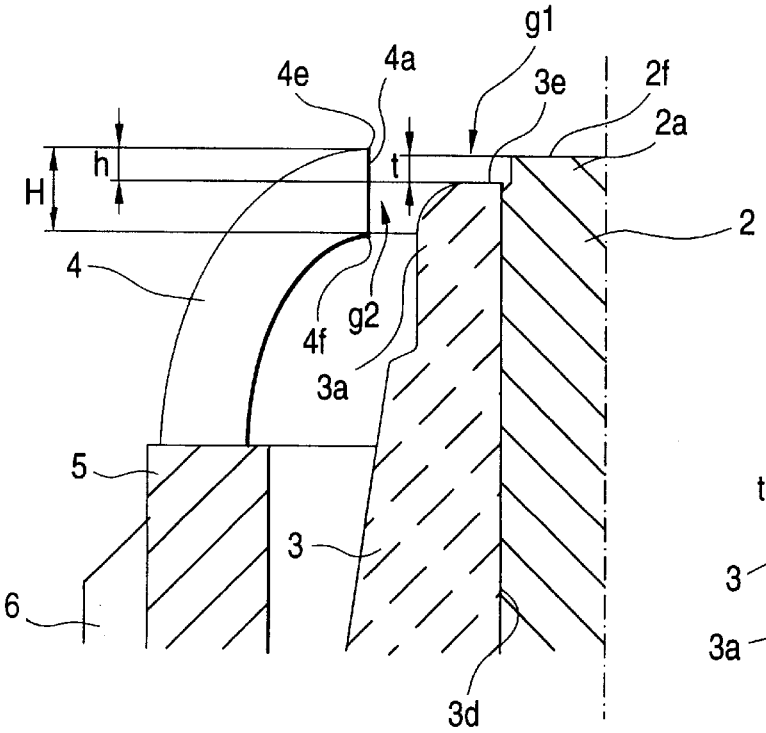

In order to further improve resistance to channeling of the spark plug 1, the distance h in the axial direction of the center electrode 2 between the tip end face 2*f* of the center electrode 2 and the edge 4*e* of the front side of the firing surface 4*a* in FIG. 8B is preferably adjusted to be in a range of 0.7 mm or less, and more preferably in a range of 0.5 mm or less. When the distance between the rear side edge 4*f* of the firing surface 4*a* of the ground electrode 4 and the front side edge 4*e* is H, it is preferable to adjust h/H to be in a range of 0.5 or less. Furthermore, H−h, which is the protrusion amount of the tip end face 3*e* of the insulator from the rear side edge 4*f* of the tip end face of the ground electrode, is set to be 1.2 mm or less.

The larger the spark plug 1 section diameter, which is the diameter of a section perpendicular to the axis of the tip end portion 2*a* of the center electrode 2, the more channeling is suppressed. The smaller the diameter of a section perpendicular to the axis, the higher the resistance to contamination. In order to balance these effects, it is preferable to adjust the diameter of a section perpendicular to the axis of the tip end portion 2*a* of the center electrode 2 to be in a range of 0.6 to 2.2 mm, and more preferably in a range of 1 to 1.8 mm.

Figure 9:
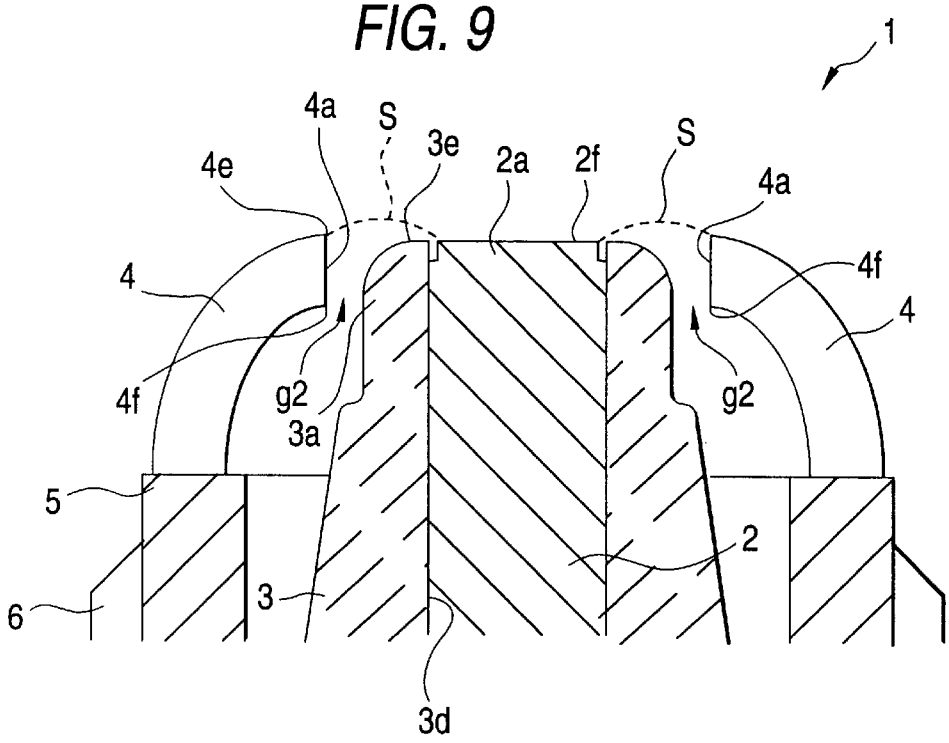
FIG. 9 is a section view showing positional relationships between a ground electrode and a center electrode in the spark plug of FIG. 2.

As shown in FIG. 9, the center electrode 2 may be configured so that the tip end face 2*f* is flush with the tip end face 3*e* of the insulator 3. Alternatively, as shown in FIG. 10, the center electrode may be configured so that the tip end face 2*f* is recessed within the tip end face 3*e* of the insulator 3. In both the cases, the outer peripheral face of the center electrode 2 is not directly opposed to the firing surface 4*a* of the ground electrode 4. When the degree of contamination is not very high, a discharge path of a spark S is formed so as to detour around the tip end portion 3*a* of the insulator 3, mainly between the front side edge 4*e* of the firing surface 4*a* of the ground electrode 4 and the tip end portion 2*a* of the center electrode 2. When contamination advances, a discharge path is formed between the conductive material deposited on the surface of the insulator 3 and the closer of the front side edge 4*e* and rear side edge 4*f* of the firing surface 4*a*.

Figure 8C:
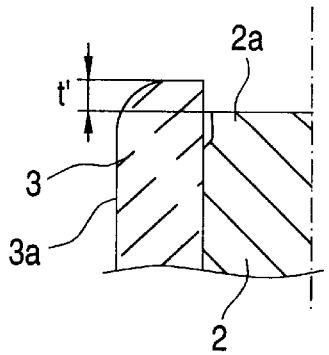

In this case, the larger the protrusion height t of the tip end face 2*f* of the center electrode 2 in FIG. 8B, the more easily a propagation path of a spark which is formed around the center electrode 2 is dispersed leading to improved resistances to channeling and contamination. In contrast, the larger the recess depth t' (FIG. 8C) of the center electrode 2, the more easily the propagation path of a spark tends to be close to the surface of the insulator 3. This causes a spark to be pressed against the surface of the insulator 3, resulting in impaired resistance to channeling. Therefore, when the center electrode 2 is to protrude from the insulator 3, the protrusion height t is preferably set to be 1 mm or less. When the center electrode is conversely recessed, the recess depth t' is preferably adjusted to be in a range of 0.3 mm or less. When the protrusion height t is larger than 1.0 mm, resistances to channeling and contamination of the spark plug 1 may be insufficient. The protrusion height t is more preferably set to be 0.5 mm or shorter. In contrast, when the recess depth t' is larger than 0.3 mm, resistance to channeling may be insufficient. The recess depth t' is more preferably adjusted to be 0.1 mm or less.

Hereinafter, various modifications of the spark plug 1 will be described.

Figure 11:
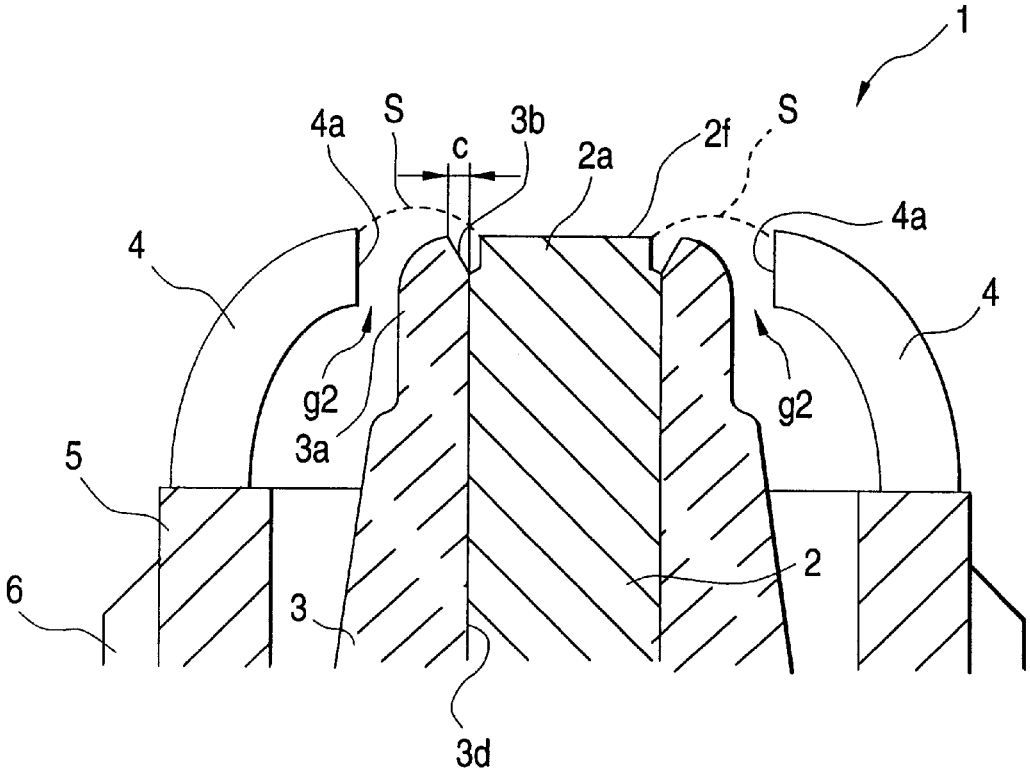
FIG. 11 is a section view showing a second modification of the spark plug of FIG. 2.

In the spark plug 1 shown in FIG. 11, a chamfered portion 3*b* may be formed in the peripheral edge portion of the opening of the hole portion 3*d* of the insulator 3 into which the center electrode 2 is to be fitted. According to this configuration, the discharge path can be dispersed, leading to further enhancement of channeling suppression. The size C of the chamfered portion 3*b* is preferably set to be about 0.2 to 0.8 mm.

Figure 15:
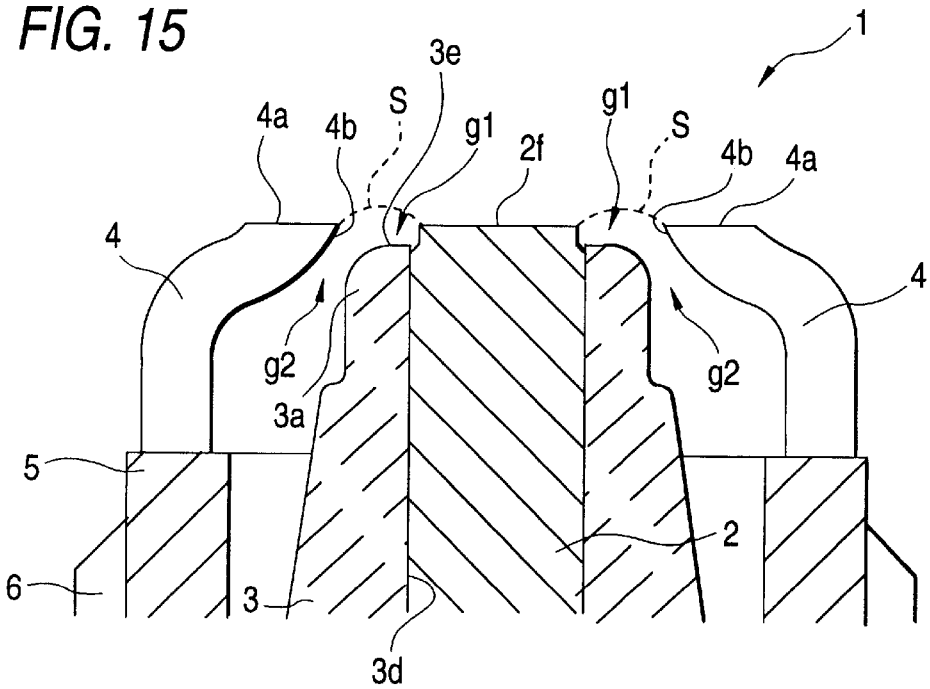
FIG. 15 is a section view showing a fifth modification of the spark plug of FIG. 2.

The configuration of the spark plug 1 is not restricted to that in which the end face 4*a* of the tip end portion of the ground electrode 4 is opposed to the side face of the center electrode 2. As shown in FIG. 15, for example, the tip end portion of the ground electrode 4 may be upwardly bent back so that the side face of the tip end portion is opposed to the side face of the center electrode 2. In this case, the opposing side face 4*b* functions as the principal firing surface. When the side face 4*b* functions as the firing surface, there is no edge portion in the rear side of the axial direction of the center electrode 2. As a result, a discharge path along which the surface of the insulator 3 is attacked is hardly formed, leading to further improvement in channeling suppression.

Figure 13:
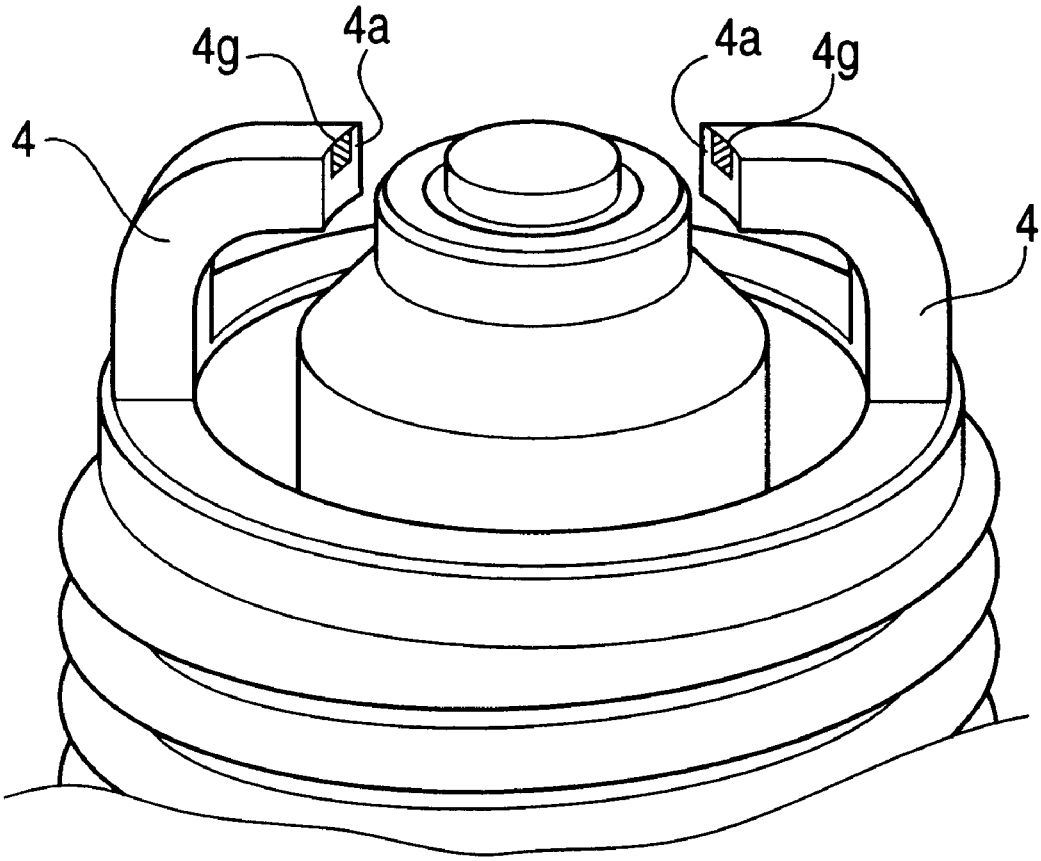
FIG. 13 is a section view showing a third modification of the spark plug of FIG. 2.

In the spark plug 1 shown in FIG. 13, at least a part of the end face 4*a* of the tip end portion of the ground electrode 4 may be made of either a metal in which at least one of Ru, Rh, Pd, Os, Ir, and Pt is a principal component, or a composite material member (for example, a metal-oxide composite material member) 4*g* that is mainly composed of the metal. For example, a Pt—Ni alloy (e.g., an alloy mainly consisting of Pt and containing 15 or more wt. % of Ni) may be used as the metal or the composite material member 4*g*.

The metal or the composite material member 4*g* may be formed by fixing chips made of the metal or the composite material member by means of laser welding or resistance welding. An electrode having a negative potential is more easily consumed by collisions of positive ions produced by discharges, as compared with an electrode having a positive potential. The above-mentioned materials constituting the end face 4*a* of the tip end portion of the ground electrode 4 are superior in heat and corrosion resistance. Thus according to this configuration, consumption of the end face 4*a* of the tip end portion of the ground electrode 4 having a negative potential can be suppressed, thereby improving the durability of the spark plug 1.

Figure 14A:
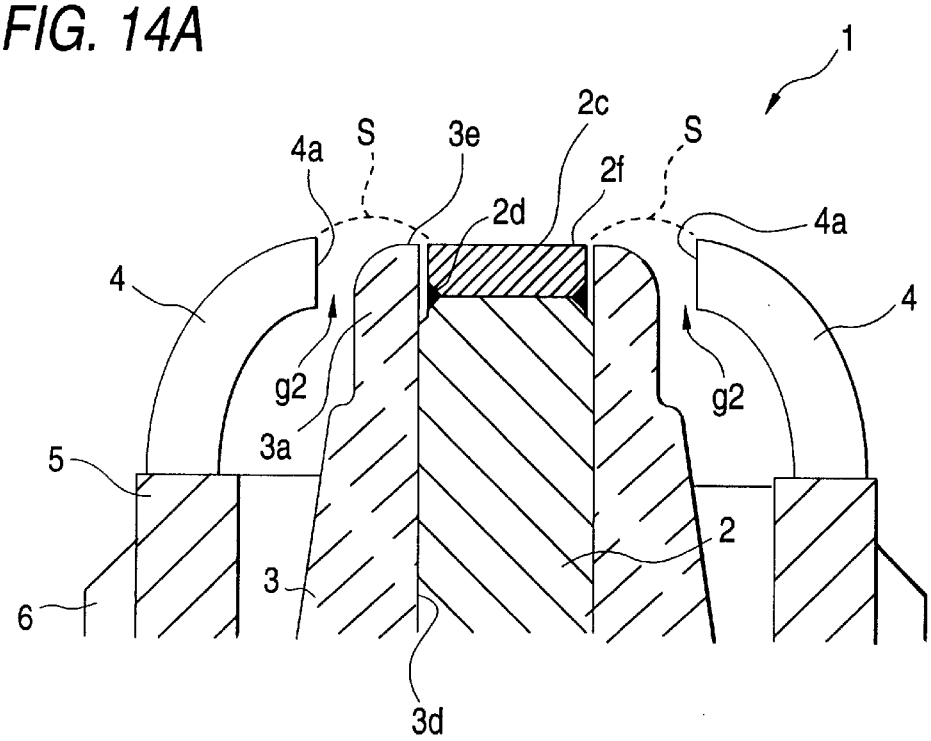
FIGS. 14A and 14B are section views showing a fourth modification of the spark plug of FIG. 2.

Furthermore, in the spark plug 1 shown in FIG. 14A, a part of the tip end portion of the center electrode 2 that includes at least the outer peripheral edge of the tip end face of the ground electrode may be formed as a firing portion 2*c*. The firing portion 2*c* is made of either a metal in which at least one of Ru, Rh, Pd, Os, Ir, and Pt is a principal component, or a composite material member (e.g., a metal-oxide composite material member) 4*g* which is mainly composed of the metal. Specifically, a Pt—Ni alloy (e.g., an alloy mainly consisting of Pt and contains 15 or more wt. % of Ni) may be used as the material of the firing portion 2*c*.

For example, the firing portion 2*c* may be formed by fixing a chip made of the metal or the composite material member by means of a welding portion 2*d*. The above-mentioned materials constituting the firing portion 2*c* are superior in heat and corrosion resistance. Therefore, consumption of the firing portion 2*c* can be suppressed, thereby improving the durability of the spark plug 1. The firing portion 2*c* may be formed into one of at least two shapes shown in FIGS. 14A and 14B. The firing portion 2*c* shown in FIG. 14A constitutes the entire tip end face 2*f* of the center electrode 2, and the firing portion 2*c* shown in FIG. 14B has an annular shape an constitutes only an edge portion of the tip end face 2*f*. In the latter case shown in FIG. 14B, the required amount of expensive noble metal can be reduced, additionally resulting in reduced production cost of the spark plug 1.

Figure 14B:
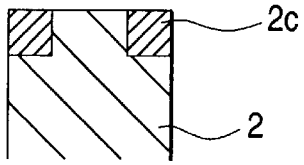
Figure 21A:
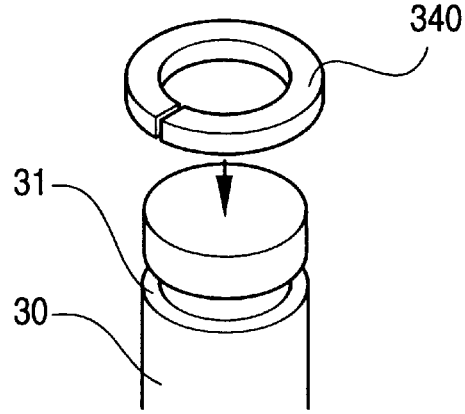
FIGS. 21A to 21D are diagrams showing production steps in an example of the method of forming a firing portion shown in FIG. 14B.
Figure 21B:
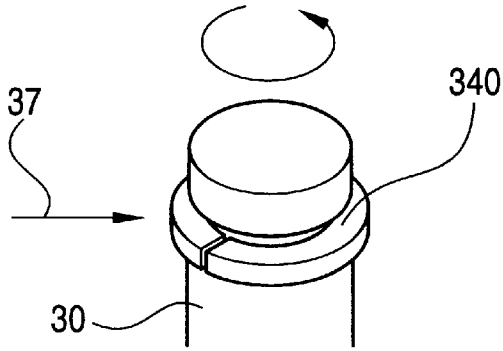
Figure 21C:
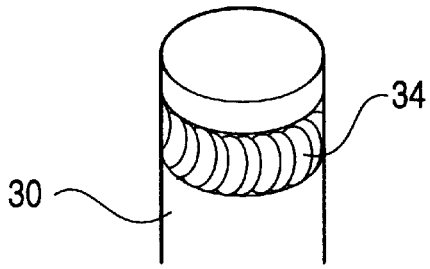
Figure 21D:
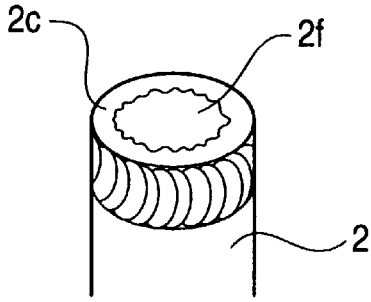

The firing portion 2*c* of FIG. 14B can be formed in the following manner. As shown in FIG. 21A, a groove (having, for example, a trapezoidal section shape) 31 is formed in the circumferential direction in the tip end portion of an electrode blank 30. The electrode blank 30 will be formed as the center electrode 2 and is made of Ni. An annular Pt member 340 (formed by, for example, rounding a Pt wire into an annular shape) is fitted into the groove 31 and then caulked. As shown in FIG. 21B, the Pt member 340 is irradiated with a laser beam 37 while the electrode blank 30 is rotated at a predetermined speed. As a result, the Pt member 340 and the electrode blank 30 melt and a Pt—Ni alloy portion 34 is then formed as shown in FIG. 21C. The irradiation conditions of the laser beam and the size of the Pt member 340 are adjusted so that the content of Ni in the resulting Pt—Ni alloy portion 34 is 15 wt. % or less. The tip end portion of the electrode blank 30 is removed by cutting, polishing, or grinding. This removal process exposes the firing portion 2*c* from the Pt—Ni alloy portion 34 at the periphery of the tip end face 2*f*, as shown in the completed center electrode 2 of FIG. 21D.

EXAMPLES

The spark plugs shown in FIGS. 2, 9, and 10 were subjected to a performance test in the following manner. Referring first to FIG. 8A, w1 was set to be 1.6 mm and the size w2 of the gap g2 to be 0.6 mm. (In the case of FIG. 2, the size of the first gap g1, and, in the cases of FIGS. 9 and 10, the distance between the firing surface 4*a* and the side face of the tip end portion of the center electrode 2, were also set to be 1.6 mm.) Referring to FIG. 8B, H was set to be 1.3 mm, t was adjusted to be in a range of 0 to 1 mm, and t' was adjusted to be in a range of 0 to 1 mm. Furthermore, h/H was set to be one of 0%, 50% and 70%. The diameter of the tip end of the center electrode 2 was adjusted to be in a range of 0.5 to 2.4 mm.

First, resistance to channeling of these spark plugs was tested in the following manner. A high voltage of a peak voltage of about 20 kV was intermittently applied at 60 Hz with the polarity of the center electrode 2 being positive, for 500 hours and under an air-pressurized atmosphere of about 5 atm. Thereafter, the-depth of a channeling groove formed in the surface of the insulator 3 was measured using a scanning electron microscope. For the sake of comparison, similar tests were conducted with the polarity of the ground electrode 4 being positive and the center electrode 2 being negative. Judgment criteria were set so that a depth smaller than 0.2 mm is light (◎), a depth of 0.2 to 0.4 mm is medium (○), and a depth larger than 0.4 mm is serious (×). The results are shown in FIGS. 18A and 18B (in the tables, the columns starting from the left side show results in the cases of h/H being 0%, 50% and 70%, respectively).

Figure 19:
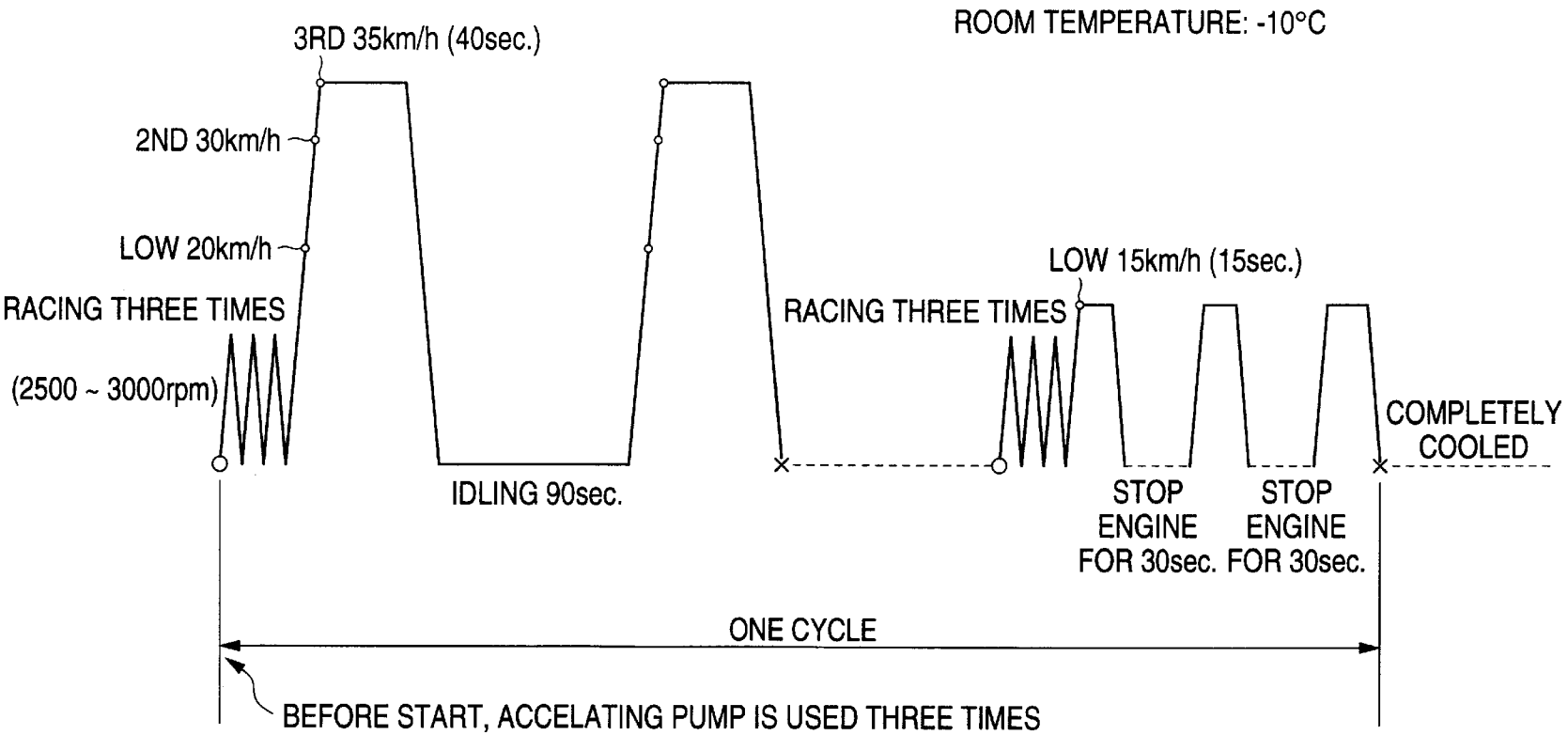
FIG. 19 is a diagram showing a driving pattern of a resistance to contamination test.

Next, in order to test resistance of the spark plugs to contamination, pre-delivery fouling tests were conducted under the following conditions. Spark plugs were attached to a test automobile with a voltage application such that the polarity of the ground electrode 4 was negative and the center electrode 2 was positive. The driving pattern shown in FIG. 19 (this is exemplified in JIS: D1606, and the temperature of the test chamber: −10° C.) was used as one cycle. The cycle was repeated until the insulation resistance of the spark plugs was reduced to 10 MΩ or less. The test was conducted based on the number of the repeated cycles so that the case of 20 cycles or more is "◎," that of 10 to 19 cycles is "○," that of 5 to 9 cycles is "Δ," and that of 4 cycles or less is "×" (◎ and ○ are fair, and Δ and × indicate failure). For the sake of comparison, similar tests were conducted with a voltage application such that the polarity of the ground electrode 4 was positive and the center electrode 2 was negative. Results are shown in FIGS. 20A and 20B.

As apparent from FIGS. 20A and 20B, the configuration of the embodiment in which the center electrode is positive (FIG. 20A) exhibits resistance to contamination being equivalent to or superior to that of the configuration of the comparison example in which the center electrode is negative (FIG. 20B). As shown in FIGS. 18A and 18B, the occurrence frequency of channeling in the insulator is remarkably reduced, and therefore the life of a spark plug can be prolonged. As shown in the embodiment of FIG. 18A, the larger the diameter of a section perpendicular to the axis of the tip end portion of the center electrode, the more enhanced the channeling suppression. As shown in FIG. 20A, the smaller the diameter of a section perpendicular to the axis, the greater the resistance to contamination. In order to attain both channeling suppression and ensurance of contamination resistance, the diameter of a section perpendicular to the axis of the tip end portion of the center electrode is preferably adjusted to be in a range of 0.6 to 2.2 mm, and more preferably 1 to 1.8 mm. Moreover, in order to further improve resistance to channeling, h/H is adjusted to be in a range of 0.5 or less.

As shown in FIG. 18A, the smaller the protrusion height t of the tip end face of the center electrode (or the smaller the recess depth t'), the greater the resistances to channeling and contamination. Further, the larger the recess depth t', the lower the resistance to channeling. It will be To seen that, in order to attain both suppression of channeling and ensurance of resistance to contamination, the protrusion height t should be set to be 1 mm or less (more preferably, 0.5 mm or less), or the recess depth t' should be 0.3 mm or less.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A spark plug comprising:

a center electrode;

a ground electrode in which a firing surface is formed in a tip end side, said firing surface being opposed to a side face of said center electrode; and an insulator which covers an outside of said center electrode and which is placed in a positional relationship that a tip end portion of said insulator is between said side face of said center electrode and said firing surface of said ground electrode;

wherein a discharge high voltage is applied across said center electrode and said ground electrode such that a polarity of said center electrode is positive, and a spark discharge is caused between said firing surface of said ground electrode and a tip end portion of said center electrode by the application of said high voltage.

2. A spark plug according to claim 1, wherein a spark due to the discharge high voltage propagates through a path which extends along a surface of said tip end portion of said insulator.

3. A spark plug according to claim 1, wherein a diameter of a section perpendicular to an axis of a tip end portion of said center electrode is set in a range of 0.6 to 2.2 mm.

4. A spark plug according to claim 1, wherein a tip end face of said center electrode is flush with or protrudes from a tip end face of said insulator, and a protrusion height t is set in a range of 1 mm or less.

5. A spark plug according to claim 1, wherein a tip end face of said center electrode is recessed into said insulator from a tip end face of said insulator, and a recess depth t' is set in a range of 0.3 mm or less.

6. A spark plug according to claim 1, further comprising a cylindrical metal shell covering an outside of said insulator;

wherein a basal end side of said ground electrode is joined to an end portion of said metal shell, said tip end side of said ground electrode is bent back toward said center electrode and a tip end face of said ground electrode is opposed to said side face of said center electrode and said tip end portion of said insulator is interposed between said tip end face and said side face so that said tip end face forms said firing surface; and wherein said tip end face side of said center electrode in an axial direction of said center electrode is a front side and a side opposite to said front side is a rear side, said tip end face of said insulator is located in front of an edge of the rear side of an end face of said ground electrode and a distance h in the axial direction between an edge of the front side of said end face of said ground electrode and said tip end face of said insulator is set in a range of 0.7 mm or less.

7. A spark plug according to claim 1, wherein a distance in the axial direction of said center electrode between said edge of the rear side of said end face of said ground electrode and said edge of the front side of said tip end face of said ground electrode is H and a distance between said tip end face of said insulator and said edge of the front side of said end face of said ground electrode is h, h/H is set to be 0.5 or less.

8. A spark plug according to claim 1, wherein a plurality of ground electrodes are arranged around said axis of said center electrode.

9. A spark plug according to claim 1, wherein at least a part of said firing surface of each of said ground electrodes is made of a metal comprising at least one of Ru, Rh, Pd, Os, Ir, and Pt, or a composite material member which is comprised of said metal.

10. An internal combustion engine igniting system, comprising:

at least one spark plug, each of the at least one spark plug including a center electrode having a side face and an outside portion;

a ground electrode having a tip end side and a firing surface formed in said tip end side and being opposed to said side face of said center electrode; and an insulator covering said outside portion of said center electrode and placed in a positional relationship so that a tip end portion of said insulator is arranged between said side face of said center electrode and said firing surface of said ground electrode; and a discharge high voltage applying circuit for applying a discharge high voltage across the center electrode and the ground electrode of each of the at least one spark plug such that the polarity of said center electrode of each of the at least one spark plug is positive.

11. The internal combustion engine igniting system of claim 10, wherein said discharge high voltage applying circuit comprises:

an ignition coil including a primary coil and a secondary coil;

a battery for supplying power to said primary coil via an ignition switch when said ignition switch is closed;

an ignitor for interrupting the energization of the primary coil and thereby generating a high voltage induction current in the secondary coil; and a distributor unit, coupled between the secondary coil and the center electrode of each of the at least one spark plug, for distributing the high voltage induction current to each of the at least one spark plug.

12. The internal combustion engine igniting system of claim 11, wherein a positive terminal of the primary coil is coupled to said battery and a negative terminal of the primary coil is coupled to the ignitor.

13. The internal combustion engine igniting system of claim 10, wherein a spark due to the discharge high voltage propagates through a path which extends along a surface of said tip end portion of said insulator.

14. The internal combustion engine igniting system of claim 10, wherein a diameter of a section perpendicular to an axis of a tip end portion of said center electrode is set in a range of 0.6 to 2.2 mm.

15. The internal combustion engine igniting system of claim 10, wherein a tip end face of said center electrode is flush with or protrudes from a tip end face of said insulator, and a protrusion height t is set in a range of 1 mm or less.

16. The internal combustion engine igniting system of claim 10, wherein a tip end face of said center electrode is recessed into said insulator from a tip end face of said insulator, and a recess depth t' is set in a range of 0.3 mm or less.

17. The internal combustion engine igniting system of claim 10, wherein said at least one spark plug further comprises a cylindrical metal shell covering an outside of said insulator; and wherein a basal end side of said ground electrode is joined to an end portion of said metal shell, said tip end side of said ground electrode is bent back toward said center electrode and a tip end face of said ground electrode is opposed to said side face of said center electrode and said tip end portion of said insulator is interposed between said tip end face and said side face so that said tip end face forms said firing surface; and wherein said tip end face side of said center electrode in an axial direction of said center electrode is a front side and a side opposite to said front side is a rear side, said tip end face of said insulator is located in front of an edge of the rear side of an end face of said ground electrode and a distance h in the axial direction between an edge of the front side of said end face of said ground electrode and said tip end face of said insulator is set in a range of 0.7 mm or less.

18. The internal combustion engine igniting system of claim 10, wherein a distance in the axial direction of said center electrode between said edge of the rear side of said end face of said ground electrode and said edge of the front side of said tip end face of said ground electrode is H and a distance between said tip end face of said insulator and said edge of the front side of said end face of said ground electrode is h, h/H being 0.5 or less.

19. The internal combustion engine igniting system of claim 10, wherein a plurality of ground electrodes are arranged around said axis of said center electrode.

20. The internal combustion engine igniting system of claim 10, wherein at least a part of said firing surface of each of said ground electrodes is made of a metal comprising at least one of Ru, Rh, Pd, Os, Ir, and Pt, or a composite material member which is comprised of said metal.

* * * * *